US012168859B2

(12) United States Patent
Fukuda et al.

(10) Patent No.: US 12,168,859 B2
(45) Date of Patent: Dec. 17, 2024

(54) WORKING MACHINE

(71) Applicant: KUBOTA CORPORATION, Osaka (JP)

(72) Inventors: Yuji Fukuda, Osaka (JP); Kohei Nagao, Osaka (JP); Ryota Hamamoto, Osaka (JP); Hiroaki Nakagawa, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 564 days.

(21) Appl. No.: 17/358,898

(22) Filed: Jun. 25, 2021

(65) Prior Publication Data

US 2022/0049469 A1 Feb. 17, 2022

(30) Foreign Application Priority Data

Aug. 15, 2020 (JP) ..... 2020-137170
Aug. 15, 2020 (JP) ..... 2020-137173
(Continued)

(51) Int. Cl.
*E02F 9/22* (2006.01)

(52) U.S. Cl.
CPC ..... *E02F 9/2253* (2013.01); *E02F 9/2246* (2013.01); *E02F 9/225* (2013.01); *E02F 9/2292* (2013.01)

(58) Field of Classification Search
CPC ..... E02F 9/2253; E02F 9/2246; E02F 9/225; E02F 9/2292; E02F 3/651; E02F 3/84;
(Continued)

(56) References Cited

U.S. PATENT DOCUMENTS 8,464,826 B2 * 6/2013 Yamada ..... F15B 11/163 180/308
2013/0332036 A1 * 12/2013 Yamamoto ..... E02F 9/2296 701/50
(Continued)

FOREIGN PATENT DOCUMENTS

JP 2002-97676 4/2002
JP 2008-248981 10/2008
(Continued)

OTHER PUBLICATIONS

Office Action issued in Corresponding JP Patent Application No. 2021-051888, dated Jan. 30, 2024, along with an English translation thereof.

*Primary Examiner* — Abby Y Lin
*Assistant Examiner* — Esvinder Singh
(74) *Attorney, Agent, or Firm* — Greenblum & Bernstein, P.L.C.

(57) ABSTRACT

A working machine includes a controller to perform an automatic deceleration operation to automatically decelerate from a second speed to a first speed when a value calculated based on a first traveling pressure, a second traveling pressure, a third traveling pressure, and a fourth traveling pressure becomes equal to or more than a deceleration threshold in a state where a left traveling motor and a right traveling motor are being driven at the second speed. The controller determines the deceleration threshold based on any one of a first cross-differential pressure acquired by subtracting the fourth traveling pressure from the first traveling pressure, a second cross-differential pressure acquired by subtracting the third traveling pressure from the second traveling pressure, a third cross-differential pressure acquired by subtracting the second traveling pressure from the third traveling pressure, and a fourth cross-differential
(Continued)

pressure acquired by subtracting the first traveling pressure from the fourth traveling pressure.

13 Claims, 9 Drawing Sheets

(30) Foreign Application Priority Data

Mar. 25, 2021 (JP) ..... 2021-051888
Apr. 30, 2021 (JP) ..... 2021-077421

(58) Field of Classification Search
CPC ..... E02F 9/0866; E02F 9/0875; E02F 9/22; E02F 9/2228; E02F 9/2267; E02F 9/2225
See application file for complete search history.

(56) References Cited

U.S. PATENT DOCUMENTS

| | | | | |
|---|---|---|---|---|
| 2017/0350095 | A1* | 12/2017 | Fukuda | E02F 9/2285 |
| 2020/0018043 | A1* | 1/2020 | Udagawa | F16H 61/12 |
| 2020/0208376 | A1 | 7/2020 | Fukuda et al. | |
| 2022/0034335 | A1* | 2/2022 | Ueda | E02F 9/2282 |

FOREIGN PATENT DOCUMENTS

| | | | |
|---|---|---|---|
| JP | 2015-64024 | | 4/2015 |
| JP | 2017-179923 | A | 10/2017 |
| JP | 2019-60450 | | 4/2019 |
| JP | 2020-46074 | | 3/2020 |
| JP | 2020-105889 | | 7/2020 |

* cited by examiner

Fig.4A

| | Cross-differential pressure |
|---|---|
| p 1 | K 1 |
| p 2 | K 2 |
| p 3 | K 3 |
| p 4 | K 4 |
| p 5 | K 5 |

Fig.6

| Prime mover rotation speed (rpm) | First traveling relief pressure (rpm)/ Second traveling relief pressure (rpm)/ Third traveling relief pressure (rpm)/ Fourth traveling relief pressure (rpm) |
|---|---|
| 2400rpm | w1(2400rpm)、w2(2400rpm)、w3(2400rpm)、w4(2400rpm) |
| 2300rpm | w1(2300rpm)、w2(2300rpm)、w3(2300rpm)、w4(2300rpm) |
| 2200rpm | w1(2200rpm)、w2(2200rpm)、w3(2200rpm)、w4(2200rpm) |
| ⋮ | ⋮ |
| 1000rpm | w1(1000rpm)、w2(1000rpm)、w3(1000rpm)、w4(1000rpm) |
| 900rpm | w1(900rpm)、w2(900rpm)、w3(900rpm)、w4(900rpm) |
| 800rpm | w1(800rpm)、w2(800rpm)、w3(800rpm)、w4(800rpm) |
| 700rpm | w1(700rpm)、w2(700rpm)、w3(700rpm)、w4(700rpm) |
| ⋮ | ⋮ |

WORKING MACHINE

CROSS-REFERENCE TO RELATED APPLICATIONS

This application claims the benefit of priority to Japanese Patent Application No. 2020-137170 filed on Aug. 15, 2020, to Japanese Patent Application No. 2020-137173 filed on Aug. 15, 2020, to Japanese Patent Application No. 2021-051888 filed on Mar. 25, 2021, and to Japanese Patent Application No. 2021-077421 filed on Apr. 30, 2021. The entire contents of this application are hereby incorporated herein by reference.

BACKGROUND OF THE INVENTION

1. Field of the Invention

The present invention relates to a working machine such as a skid steer loader, a compact track loader, and a backhoe.

2. Description of the Related Art

Japanese unexamined patent application publication No. 2017-179923 discloses a technique for decelerating and accelerating a working machine. The working machine described in Japanese unexamined patent application publication No. 2017-179923 has a prime mover including an engine, a hydraulic pump configured to be operated by power of the prime mover and to supply an operation fluid, a traveling hydraulic device configured to switch a speed between a first speed and a second speed that is faster than the first speed according to a pressure of the operation fluid, an operation valve configured to change the pressure of the operation fluid applied to the traveling hydraulic device, and a measurement device configured to detect the pressure of the operation fluid. When a detected pressure, which is a pressure of the operation fluid detected by the measurement device, drops from a set pressure corresponding to the second speed to a predetermined pressure or lower, the operation valve reduces the pressure of the operation fluid applied to the traveling hydraulic device to decelerate the traveling hydraulic device to the first speed.

SUMMARY OF THE INVENTION

A working machine includes a machine body, a prime mover provided on the machine body, a left traveling device provided on a left portion of the machine body, a right traveling device provided on a right portion of the machine body, a left traveling motor configured to output power to the left traveling device and to be rotated at a speed stage shiftable between a first speed and a second speed higher than the first speed, a right traveling motor configured to output power to the right traveling device and to be rotated at a speed stage shiftable between a first speed and a second speed higher than the first speed, a left traveling pump to supply operation fluid to the left traveling motor, a right traveling pump to supply operation fluid to the right traveling motor, a first circulation fluid line fluidly connecting the left traveling pump to the left traveling motor, the first circulation fluid line including a first passage connecting a first port of the left traveling pump to a first port of the left traveling motor, and a second passage connecting a second port of the left traveling pump to a second port of the left traveling motor, a second circulation fluid line fluidly connecting the right traveling pump to the right traveling motor, the second circulation fluid line including a third passage connecting a third port of the right traveling pump to a third port of the right traveling motor, and a fourth passage connecting a fourth port of the right traveling pump to a fourth port of the right traveling motor, a first pressure detector provided on the first passage and configured to detect a first traveling pressure that is a pressure of operation fluid applied to the first passage when the left traveling motor rotates, a second pressure detector provided on the second passage and configured to detect a second traveling pressure that is a pressure of operation fluid applied to the second passage when the left traveling motor rotates, a third pressure detector provided on the third passage and configured to detect a third traveling pressure that is a pressure of operation fluid applied to the third passage when the right traveling motor rotates, a fourth pressure detector provided on the fourth passage and configured to detect a fourth traveling pressure that is a pressure of operation fluid applied to the fourth passage when the right traveling motor rotates, and a controller to perform an automatic deceleration operation to automatically decelerate the left traveling motor and the right traveling motor each rotated at the second speed by shifting the speed stage of rotation of each of the left and right traveling motors from the second speed to the first speed when a value calculated based on the first traveling pressure, the second traveling pressure, the third traveling pressure, and the fourth traveling pressure becomes equal to or more than a deceleration threshold. The controller determines the deceleration threshold based on any one of a first cross-differential pressure acquired by subtracting the fourth traveling pressure from the first traveling pressure, a second cross-differential pressure acquired by subtracting the third traveling pressure from the second traveling pressure, a third cross-differential pressure acquired by subtracting the second traveling pressure from the third traveling pressure, and a fourth cross-differential pressure acquired by subtracting the first traveling pressure from the fourth traveling pressure.

The controller decreases the deceleration threshold according to increase of any one of cross-differential pressures consisting of the first cross-differential pressure, the second cross-differential pressure, the third cross-differential pressure, and the fourth cross-differential pressure, and increases the deceleration threshold according to decrease of the one of the cross-differential pressures.

The controller determines the deceleration threshold according to a rotation speed of the prime mover.

A working machine includes a machine body, a prime mover provided on the machine body, a left traveling device provided on a left portion of the machine body, a right traveling device provided on a right portion of the machine body, a left traveling motor configured to output power to the left traveling device and to be rotated at a speed stage shiftable between a first speed and a second speed higher than the first speed, a right traveling motor configured to output power to the right traveling device and to be rotated at a speed stage shiftable between a first speed and a second speed higher than the first speed, a left traveling pump to supply operation fluid to the left traveling motor, a right traveling pump to supply operation fluid to the right traveling motor, a first circulation fluid line fluidly connecting the left traveling pump to the left traveling motor, the first circulation fluid line including a first passage connecting a first port of the left traveling pump to a first port of the left traveling motor, and a second passage connecting a second port of the left traveling pump to a second port of the left traveling motor, a second circulation fluid line fluidly connecting the right traveling pump to the right traveling motor, the second circulation fluid line including a third passage connecting a third port of the right traveling pump to a third port of the right traveling motor, and a fourth passage connecting a fourth port of the right traveling pump to a fourth port of the right traveling motor, a first pressure detector provided on the first passage and configured to detect a first traveling pressure that is a pressure of operation fluid applied to the first passage of when the left traveling motor rotates, a second pressure detector provided on the second passage and configured to detect a second traveling pressure that is a pressure of operation fluid applied to the second passage when the left traveling motor rotates, a third pressure detector provided on the third passage and configured to detect a third traveling pressure that is a pressure of operation fluid applied to the third passage when the right traveling motor rotates, a fourth pressure detector provided on the fourth passage and configured to detect a fourth traveling pressure that is a pressure of operation fluid applied to the fourth passage when the right traveling motor rotates, and a controller configured to judge whether the machine body is turning or not based on the first traveling pressure, the second traveling pressure, the third traveling pressure, the fourth traveling pressure, and a first threshold, and to change the first threshold.

The controller judges whether the machine body is turning or not based on a first left-right differential pressure acquired by subtracting the third traveling pressure from the first traveling pressure, a second left-right differential pressure acquired by subtracting the first traveling pressure from the third traveling pressure, a third left-right differential pressure acquired by subtracting the fourth traveling pressure from the second traveling pressure, and a fourth left-right differential pressure acquired by subtracting the second traveling pressure from the fourth traveling pressure, and the first threshold.

The controller, after determining that the machine body is turning, judges whether the machine body finishes turning or not based on the first traveling pressure, the second traveling pressure, the third traveling pressure, the fourth traveling pressure, and a second threshold.

A working machine includes a machine body, a prime mover provided on the machine body, a left traveling device provided on a left portion of the machine body, a right traveling device provided on a right portion of the machine body, a left traveling motor configured to output power to the left traveling device and to be rotated at a speed stage shiftable between a first speed and a second speed higher than the first speed, a right traveling motor configured to output power to the right traveling device and to be rotated at a speed stage shiftable between a first speed and a second speed higher than the first speed, a left traveling pump to supply operation fluid to the left traveling motor, a right traveling pump to supply operation fluid to the right traveling motor, a first circulation fluid line fluidly connecting the left traveling pump to the left traveling motor, the first circulation fluid line including a first passage connecting a first port of the left traveling pump to a first port of the left traveling motor, and a second passage connecting a second port of the left traveling pump to a second port of the left traveling motor, a second circulation fluid line fluidly connecting the right traveling pump to the right traveling motor, the second circulation fluid line including a third passage connecting a third port of the right traveling pump to a third port of the right traveling motor, and a fourth passage connecting a fourth port of the right traveling pump to a fourth port of the right traveling motor, a first pressure detector provided on the first passage and configured to detect a first traveling pressure that is a pressure of operation fluid applied to the first passage when the left traveling motor rotates, a second pressure detector provided on the second passage and configured to detect a second traveling pressure that is a pressure of operation fluid applied to the second passage when the left traveling motor rotates, a third pressure detector provided on the third passage and configured to detect a third traveling pressure that is a pressure of operation fluid applied to the third passage when the right traveling motor rotates, a fourth pressure detector provided on the fourth passage and configured to detect a fourth traveling pressure that is a pressure of operation fluid applied to the fourth passage when the right traveling motor rotates, and a controller configured to judge whether the machine body is traveling straight or not based on the first traveling pressure, the second traveling pressure, the third traveling pressure, the fourth traveling pressure, and a first threshold, and to change the first threshold.

The controller judges whether the machine body is traveling straight or not based on a first left-right differential pressure acquired by subtracting the third traveling pressure from the first traveling pressure, a second left-right differential pressure acquired by subtracting the first traveling pressure from the third traveling pressure, a third left-right differential pressure acquired by subtracting the fourth traveling pressure from the second traveling pressure, and a fourth left-right differential pressure acquired by subtracting the second traveling pressure from the fourth traveling pressure, and the first threshold.

After determining that the machine body is turning based on the first traveling pressure, the second traveling pressure, the third traveling pressure, the fourth traveling pressure, and a first threshold, the controller judges whether the machine body starts to travel straight or not based on the first traveling pressure, the second traveling pressure, the third traveling pressure, the fourth traveling pressure, and a second threshold.

The controller changes the first threshold based on the first traveling pressure, the second traveling pressure, the third traveling pressure, or the fourth traveling pressure.

The working machine includes a first relief valve connected to the first passage, a second relief valve connected to the second passage, a third relief valve connected to the third passage, and a fourth relief valve connected to the fourth passage. The controller determines the first threshold based on a first traveling relief pressure of the first relief valve, a second traveling relief pressure of the second relief valve, a third traveling relief pressure of the third relief valve, and a fourth traveling relief pressure of the fourth relief valve. The first, second, third and fourth traveling relief pressures are determined in correspondence to a rotation speed of the prime mover.

The controller determines the second threshold based on the first traveling relief pressure, the second traveling relief pressure, the third traveling relief pressure, and the fourth traveling relief pressure.

In a state where the left traveling motor and the right traveling motor are each rotated at the second speed defining a high speed range, the controller performs an automatic deceleration operation to automatically decelerate the left traveling motor and the right traveling motor by shifting the speed stage of rotation of each of the left and right traveling motors from the second speed to the first speed defining a low speed range based on the first traveling pressure, the second traveling pressure, the third traveling pressure, and the fourth traveling pressure.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

FIG. 4A is a view showing the relationship between the cross-differential pressure and a correction factor $\eta_2$.

FIG. 6 is a view showing a relationship between traveling relief pressures and a prime mover rotation speed.

DETAILED DESCRIPTION OF THE PREFERRED EMBODIMENTS

Figure 1:
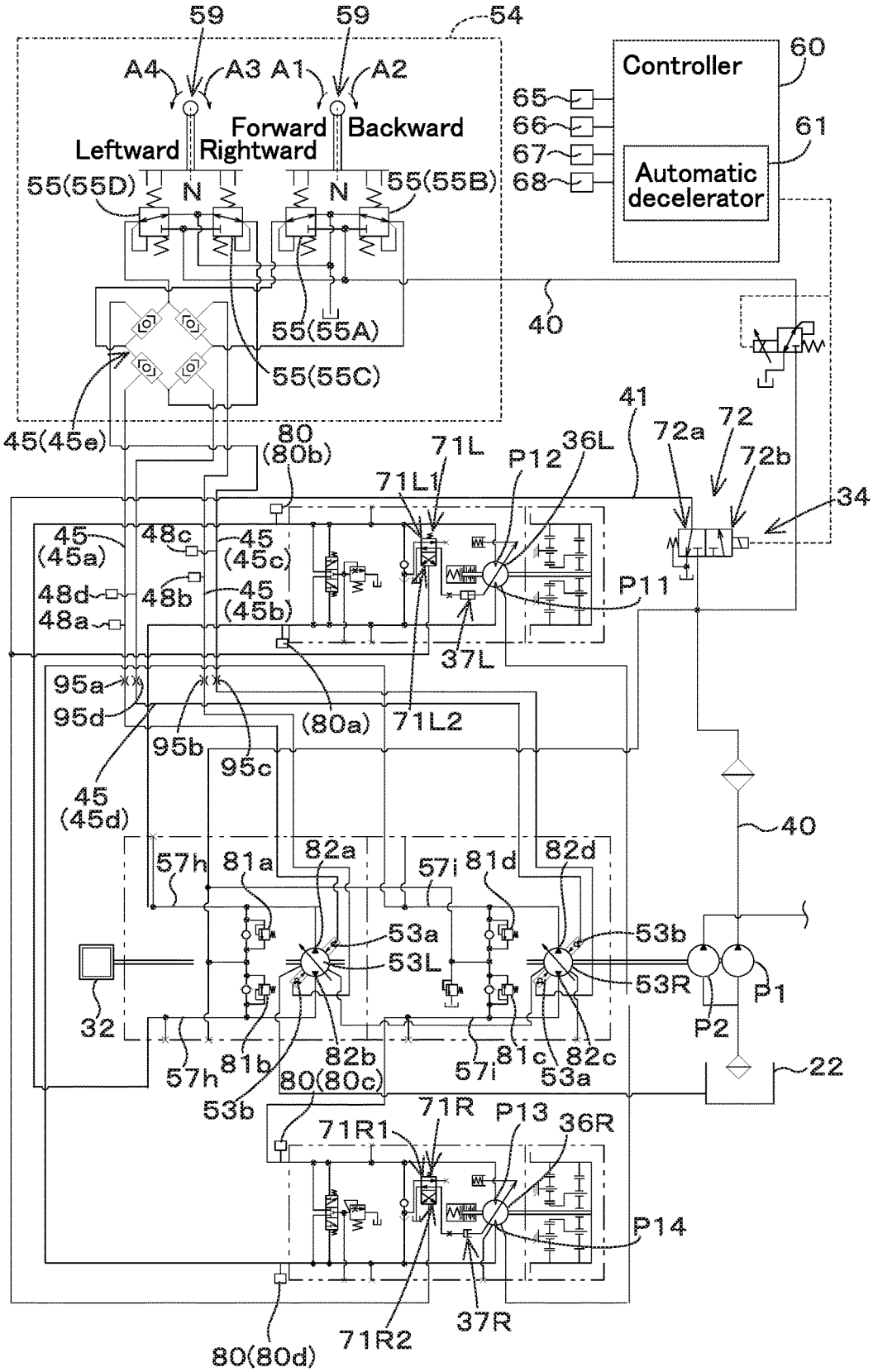
FIG. 1 is a view showing a hydraulic system (a hydraulic circuit) for a working machine.

The preferred embodiments will now be described with reference to the accompanying drawings, wherein like reference numerals designate corresponding or identical elements throughout the various drawings. The drawings are to be viewed in an orientation in which the reference numerals are viewed correctly.

With reference to drawings as appropriate, a preferred embodiment of a hydraulic system for a working machine and the working machine having the hydraulic system will be described below.

Figure 7:
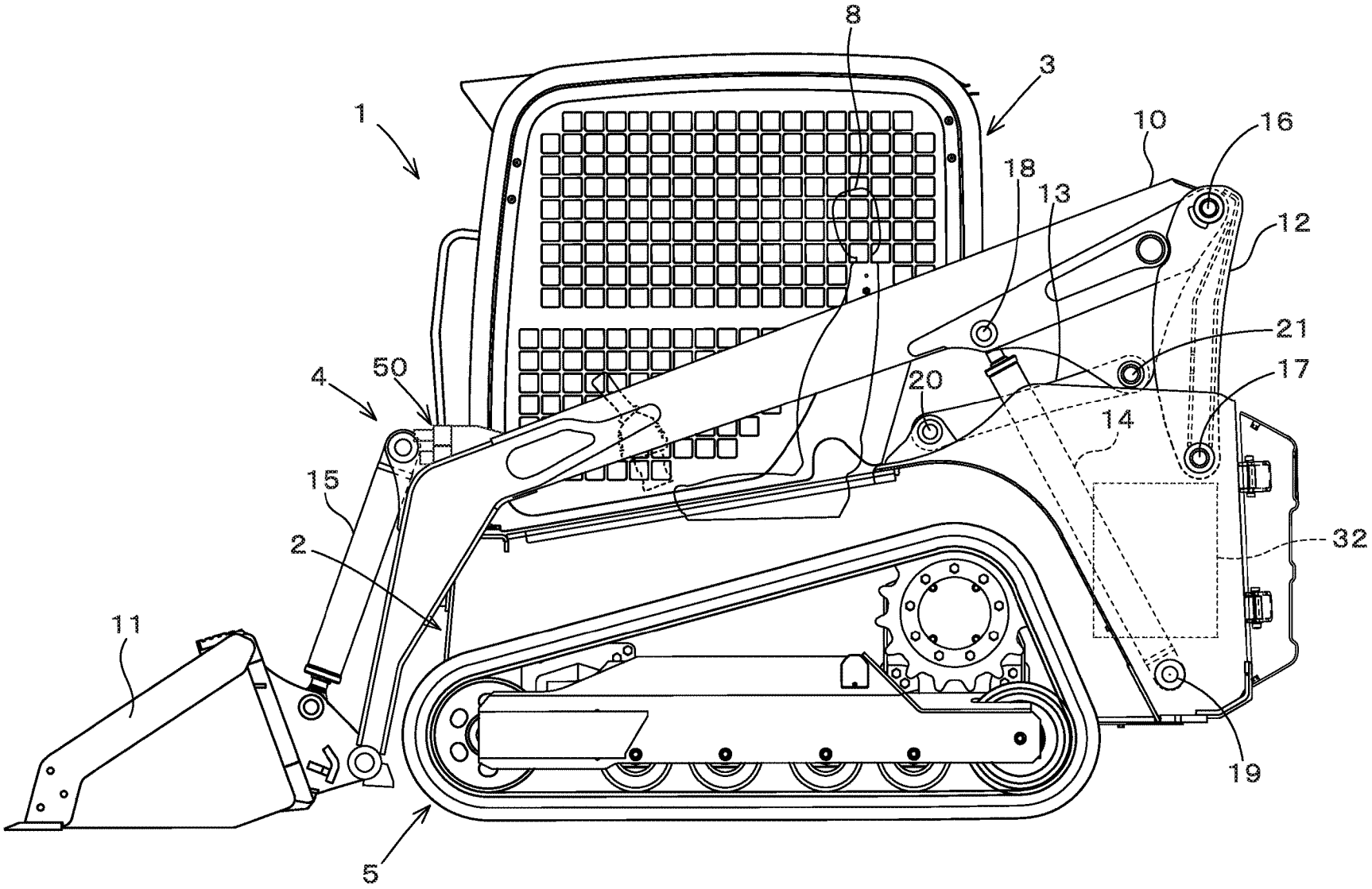
FIG. 7 is a side view showing a track loader that is an example of the working machine.

FIG. 7 shows a side view of a working machine of the present invention. FIG. 7 shows a compact track loader as an example of the working machine. However, the working machine of the present invention is not limited to the compact track loader, but may be other types of loader working machines, such as a skid steer loader, for example. In addition, the working machine may be a working machine other than the loader working machine.

As shown in FIG. 7, a working machine 1 has a machine body 2, a cabin 3, a working device 4, and a pair of traveling devices 5L and 5R. In the embodiment of the present invention, a forward direction of a driver siting on a driver seat 8 of the working machine 1 (a left side in FIG. 7) is referred to as the front, a rearward direction of the driver (a right side in FIG. 7) is referred to as the rear, a leftward direction of the driver (a front surface side of FIG. 7) is referred to as the left, and a rightward direction of the driver (a back surface side of FIG. 7) is referred to as the right. A horizontal direction, which is orthogonal to a fore-and-aft direction, is referred to as a machine width direction. A direction from the center of the machine body 2 to the right or left is referred to as a machine outward direction. In other words, the machine outward direction is the machine width direction and separates away from the machine body 2. A direction opposite to the machine outward direction is referred to as a machine inward direction. In other words, the machine inward direction is the machine width direction and approaches the machine body 2.

The cabin 3 is mounted on the machine body 2. The cabin 3 incorporates the driver seat 8. The working device 4 is attached to the machine body 2. A pair of traveling devices 5L and 5R are arranged on left and right outer sides of the machine body 2. A prime mover 32 is mounted inside a rear portion of the machine body 2.

The working device 4 includes a pair of booms 10, a working tool 11, a pair of lift links 12, a pair of control links 13, a pair of boom cylinders 14, and a pair of bucket cylinders 15.

The booms 10 are vertically rotatably provided on right and left sides of the cabin 3. A bucket (hereinafter referred to as a bucket 11) serves as an example of the working tool 11. Hereinafter, the bucket representative of various kinds of working tools 11 is referred to as "bucket 11". The bucket 11 is vertically movably provided on front tip portions of the booms 10. The booms 10 are vertically rotatably supported at rear basal portions thereof by the lift links 12 and the control links 13. The boom cylinders 14 are extended and contracted to raise and lower the booms 10. The bucket cylinders 15 are extended and contracted to swing the bucket 11 up and down.

The right and left booms 10 are connected to each other at the front tip portions thereof by a deformed connecting pipe, and at the rear base portions thereof by a circular connecting pipe.

Pairs of the lift link 12, control link 13, and boom cylinder 14 are arranged respectively right and left on the machine body 2, corresponding to the right and left booms 10.

The lift links 12 are extended vertically from the rear basal portions of the booms 10. Upper ends of the lift links 12 are pivotally connected to rear ends of the rear basal portions of the booms 10 via first pivot shafts 16 so as to be rotatable around lateral axes of the first pivot shafts 16. Lower ends of the lift links 12 are pivotally connected to a rear end portion of the machine body 2 via second pivot shafts 17 so as to be rotatable around lateral axes of the second pivot shafts 17. The second pivot shafts 17 are provided below the first pivot shafts 16.

Upper portions of the boom cylinders 14 are pivoted on third pivot shafts 18 (referred to as third pivot shafts). The third pivot shafts 18 are provided at the base portions of the booms 10, that is, at front portions of the base portions. Lower portions of the boom cylinders 14 are supported turnably around the lateral axis by pivot shafts 19 (referred to as fourth pivot shafts). The fourth pivot shafts 19 are provided near a lower portion of the rear portion of the machine body 2 and below the third pivot shafts 18.

The control links 13 are provided in front of the lift links 12. One ends of the control links 13 are supported turnably around the lateral axis by pivot shafts 20 (referred to as fifth pivot shafts). The fifth pivot shafts 20 are provided, in the machine body 2, on positions forward of the lift links 12. The other ends of the control links 13 are supported turnably around the lateral axis by pivot shafts 21 (referred to as sixth pivot shafts). The sixth pivot shafts 21 are provided, in the boom 10, forward of and above the second pivot shafts 17.

By extending and contracting the boom cylinders 14, the booms 10 is swung up and down around the first pivot shafts 16 with the base portions of the booms 10 supported by the lift links 12 and the control links 13, thereby lifting and lowering the tip end portions of the booms 10. The control links 13 are swung up and down around the fifth pivot shafts 20 by the vertical swinging of the booms 10. The lift links 12 are swung back and forth around the second pivot shafts 17 by the vertical swinging of the control links 13.

Another working tool can be attached to the front portions of the booms 10 instead of the bucket 11. The other working tools are, for example, attachments (that is, auxiliary attachments) such as hydraulic crushers, hydraulic breakers, angle brooms, earth augers, pallet forks, sweepers, mowers, snow blowers, or the like.

A connector member 50 is provided at the front portion of the left boom 10. The connector member 50 is a device configured to connect a hydraulic equipment attached to the auxiliary attachment to a first piping member such as a pipe provided on the left boom 10. Specifically, the first piping member can be connected to one end of the connector member 50, and a second piping member connected to the hydraulic equipment of the auxiliary attachment can be connected to the other end. In this manner, an operation fluid flowing in the first piping member passes through the second piping member and is supplied to the hydraulic equipment.

The bucket cylinders 15 are provided respectively near the front portions of the booms 10. The bucket cylinders 15 are extended and contracted to swing the bucket 11.

Of the pair of traveling devices 5L and 5R, the traveling device 5L is provided left on the machine body 2, and the traveling device 5R is provided right on the machine body 2. In the embodiment, a crawler type (including a semi-crawler type) traveling device is adopted for the pair of traveling devices 5L and 5R. A wheel-type traveling device having front wheels and rear wheels may also be adopted. For convenience of explanation, the traveling device 5L may be referred to as the left traveling device 5L, and the traveling device 5R may be referred to as the right traveling device 5R.

The prime mover 32 is an internal combustion engine such as a diesel engine, gasoline engine, an electric motor, or the like. In the embodiment, the prime mover 32 is the diesel engine, but is not limited thereto.

The hydraulic system for the working machine 1 will be described below.

As shown in FIG. 1, the hydraulic system for the working machine 1 has a first hydraulic pump P1 and a second hydraulic pump P2. The first hydraulic pump P1 is a pump to be driven by a power of prime mover 32 and is constituted of a constant displacement gear pump. The first hydraulic pump P1 is capable of outputting operation fluid stored in a tank 22. Specifically, the first hydraulic pump P1 outputs operation fluid that is mainly used for control. For convenience of explanation, the tank 22 that stores operation fluid may be referred to as an operation fluid tank. Of the operation fluid output from the first hydraulic pump P1, the operation fluid used for control is referred to as pilot fluid, and a pressure of the pilot fluid is referred to as a pilot pressure.

The second hydraulic pump P2 is a pump to be driven by the power of prime mover 32, and is constituted of a constant displacement gear pump. The second hydraulic pump P2 is capable of outputting operation fluid stored in the tank 22 and, for example, supplies the operation fluid to fluid lines of a working system. For example, the second hydraulic pump P2 supplies operation fluid to control valves (that is, flow-rate control valves) that control the boom cylinders 14 for operating the booms 10, the bucket cylinders 15 for operating the bucket, and an auxiliary hydraulic actuator for operating the auxiliary hydraulic actuator.

The hydraulic system for the working machine 1 has a pair of traveling motors 36L and 36R and a pair of traveling pumps 53L and 53R. The pair of traveling motors 36L and 36R transmit power to the pair of traveling devices 5L and 5R. Of the pair of traveling motors 36L and 36R, the traveling motor 36L transmits rotational power to the traveling device (referred to as a left traveling device) 5L, and the traveling motor 36R transmits rotational power to the traveling device (referred to as a right traveling device) 5R.

The pair of traveling pumps 53L and 53R are pumps to be driven by the power of prime mover 32 and are, for example, variable displacement axial pumps of swash plate type. The pair of traveling pumps 53L and 53R are driven to supply operation fluid respectively to the pair of traveling motors 36L and 36R. Of the pair of traveling pumps 53L and 53R, the traveling pump 53L supplies the operation fluid to the traveling motor 36L, and the traveling pump 53R supplies the operation fluid to the traveling motor 36R.

For convenience of explanation, the traveling pump 53L may be referred to as a left traveling pump 53L, the traveling pump 53R may be referred to as a right traveling pump 53R, the traveling motor 36L may be referred to as a left traveling motor 36L, and the traveling motor 36R may be referred to as a right traveling motor 36R.

The left traveling pump 53L and the right traveling pump 53R have a pressure receiver portion 53*a* and a pressure receiver portion 53*b* to which a pressure (that is, a pilot pressure) of the operation fluid (that is, pilot fluid) from the first hydraulic pump P1 is applied, and angles of the swash plates are changed by the pilot pressures applied to the pressure receiver portions 53*a* and 53*b*. By changing the angles of the swash plates, outputs (that is, output rates of operation fluid) and output directions of operation fluid can be changed in the left traveling pump 53L and the right traveling pump 53R. The left traveling pump 53L has a first port 82*a* to output operation fluid for forward rotation of the left traveling motor 36L and a second port 82*b* to output operation fluid for reverse rotation of the left traveling motor 36L. The right traveling pump 53R has a third port 82*c* to output operation fluid for forward rotation of the right traveling motor 36R and a fourth port 82*d* to output operation fluid for reverse rotation of the right traveling motor 36R.

A first circulation fluid line 57*h* fluidly connects the left traveling pump 53L to the left traveling motor 36L so that operation fluid delivered from the left traveling pump 53L is supplied to the left traveling motor 36L via the first circulation fluid line 57*h*. The first circulation fluid line 57*h* includes a first passage connecting the first port 82*a* of the left traveling pump 53L to a first port P11 of the left traveling motor 36L, and a third passage connecting the second port 82*b* of the left traveling pump 53L to a second port P12 of the left traveling motor 36L. A second circulation fluid line 57*i* fluidly connects the right traveling pump 53R to the right traveling motor 36R so that the right traveling pump 53R supplies operation fluid to the right traveling motor 36R via the second circulation fluid line 57*i*. The second circulation fluid line 57*i* includes a third passage connecting the third port 82*c* of the right traveling pump 53R to a third port P13 of the right traveling motor 36R, and a fourth passage connecting the fourth port 82*d* of the right traveling pump 53R to a fourth port P14 of the right traveling motor 36R.

A first relief valve 81*a* is connected to the first passage of the first circulation fluid line 57*h* extended from the first port 82*a* of the left traveling pump 53L, and a second relief valve 81*b* is connected to the second passage of the first circulation fluid line 57*h* extended from the second port 82*b* of the left traveling pump 53L. For example, the first relief valve 81*a* is likely to act to relieve excess pressure when a pressure applied to the first passage of the first circulation fluid line 57*h* is increased due to operation fluid delivered from the first port 82*a* of the left traveling pump 53L for forward rotation of the left traveling motor 36L, and the second relief valve 81*b* is likely to act to relieve excess pressure when a pressure applied to the second passage of the first circulation fluid line 57*h* is increased due to operating fluid delivered from the second port 81*b* of the left traveling pump 53L for reverse rotation of the left traveling motor 36L.

A third relief valve 81*c* is fluidly connected to the third passage of the second circulation fluid line 57*i* extended from the third port 82*c* of the right traveling pump 53R, and a fourth relief valve 81*d* is fluidly connected to the fourth passage of the second circulation fluid line 57*i* extended from the fourth port 82*d* of the right traveling pump 53R. For example, the third relief valve 81*c* is likely to act to relieve excess pressure when a pressure applied to the third passage of the connecting fluid line 57*i* is increased due to operation fluid delivered from the third port 82*c* of the right traveling pump 53R for forward rotation of the right traveling motor 36R, and the fourth relief valve 81*d* is likely to act to relieve excessive pressure when a pressure applied to the fourth passage of the second circulation fluid line 57*i* is increased due to operation fluid delivered from the fourth port 82*d* of the right traveling pump 53R for reverse rotation of the right traveling motor 36R.

The left traveling motor 36L is capable of being rotated by pressure of operation fluid delivered from the left traveling pump 53L. By changing a flow rate of operation fluid to the left traveling motor 36L, a rotation speed of the left traveling motor 36L can be changed. A swash plate switching cylinder 37L is operably connected to the left traveling motor 36L. By extending or contracting the swash plate switching cylinder 37L in one or the other direction, a rotation speed of the left traveling motor 36L can be changed. That is, when the swash plate switching cylinder 37L is contracted, the rotation speed of the left traveling motor 36L is set at a low speed stage referred to as a first speed defining a predetermined low speed range. When the swash plate switching cylinder 37L is extended, the rotation speed of the left traveling motor 36L is set at a high speed stage referred to as a second speed defining a predetermined high speed range. That is, a speed stage of rotation speed of the left traveling motor 36L is shiftable between the first speed and the second speed.

The right traveling motor 36R is capable of being rotated by pressure of operation fluid delivered from the right traveling pump 53R. By changing a flow rate of operation fluid to the right traveling motor 36R, a rotation speed of the right traveling motor 36R can be changed. A swash plate switching cylinder 37R is operably connected to the right traveling motor 36R. By extending or contracting the swash plate switching cylinder 37R in one or the other direction, a rotation speed of the right traveling motor 36R can be changed. That is, when the swash plate switching cylinder 37R is contracted, the rotation speed of the right traveling motor 36R is set at a low speed stage referred to as a first speed defining a predetermined low speed range. When the swash plate switching cylinder 37R is extended, the rotation speed of the right traveling motor 36R is set at a high speed stage referred to as a second speed defining a predetermined high speed range. That is, a speed stage of rotation speed of the right traveling motor 36R is shiftable between the first speed and the second speed.

As shown in FIG. 1, the hydraulic system for the working machine 1 has a traveling switching valve 34. The traveling switching valve 34 is shiftable between a first valve state and a second valve stage. In the first valve state, the rotation speeds of the traveling motors 36L and 36R are each set at the first speed. In the second valve state, the rotation speeds of the traveling motors 36L and 36R are each set at the second speed. The travel switching valve 34 is a valve assembly including first switching valves 71L and 71R and a second switching valve 72.

The first switching valve 71L is connected via a fluid line to the swash plate switching cylinder 37L of the left traveling motor 36L, and is constituted of a two-position switching valve shiftable between a first position 71L1 and a second position 71L2. The first switching valve 71L when set in the first position 71L1 contracts the swash plate switching cylinder 37L. The first switching valve 71L when set in the second position 71L2 extends the swash plate switching cylinder 37L.

The first switching valve 71R is connected via a fluid line to the swash plate switching cylinder 37R of the right traveling motor 36R, and is constituted of a two-position switching valve shiftable between a first position 71R1 and a second position 71R2. The first switching valve 71R when set in the first position 71R1 contracts the swash plate switching cylinder 37R when in the first position 71R1, and the first switching valve 71R when set in the second position 71R2 extends the swash plate switching cylinder 37R.

The second switching valve 72 is a solenoid valve that switches the first switching valve 71L and the first switching valve 71R, and is constituted of a two-position switching valve configured to be magnetized to switch between a first position 72*a* and a second position 72*b*. The second switching valve 72, the first switching valve 71L and the first switching valve 71R are connected to one another by a fluid line 41. The second switching valve 72 when set in a first position 71L switches the first switching valve 71L and the first switching valve 71R to the respective first positions 71L1 and 71R1. The second switching valve 72 when set in a second position 71R switches the first switching valve 71L and the first switching valve 71R to the respective second positions 71L2 and 71R2.

That is, the traveling switching valve 34 is set in the first state to contract the swash plate switching cylinders 37L and 37R and set the rotation speed of each of the traveling motors 36L and 36R at the first speed when the second switching valve 72 is at the first position 72*a*, the first switching valve 71L is at the first position 71L1, and the first switching valve 71R is at the first position 71R1. The traveling switching valve 34 is set in the second state to extend the swash plate switching cylinders 37L and 37R and set the rotation speed of each of the traveling motors 36L and 36R at the second speed when the second switching valve 72 is at the second position 72*b*, the first switching valve 71L is at the second position 71L2, and the first switching valve 71R is at the second position 71R2. Accordingly, the traveling switching valve 34 allows the traveling motors 36L and 36R to be each switched between the first speed and the second speed.

An operation device (that is, a traveling operating device) 54 is configured to apply operation fluid to the pressure receiver portions 53*a* and 53*b* of the traveling pumps 53L and 53R (that is, the left traveling pump 53L and the right traveling pump 53R) when a traveling operation member 59 is operated, and is capable of changing the angles of swash plates (referred to as swash plate angles) of the traveling pumps 53L and 53R. The operation device 54 includes the traveling operation member 59 and a plurality of operation valves 55.

The traveling operation member 59 is an operation lever that is supported by the operation valves 55 and swings in a lateral direction (that is, the machine width direction) or the fore- and-aft direction. That is, relative to a neutral position N, the traveling operation member 59 is operable to the right and to the left from a neutral position N, and to the front and to the rear from the neutral position N. In other words, the traveling operation member 59 is swingable in at least four directions with reference to the neutral position N. For convenience of explanation, the forward and backward directions, that is, the fore-and-aft direction, may be referred to as a first direction. The rightward and leftward directions, that is, the lateral direction (that is, the machine width direction), may be referred to as a second direction.

The plurality of operation valves 55 are operated by the common, a single, traveling operation member 59. The plurality of operation valves 55 are actuated based on swinging of the traveling operation member 59. An output fluid line 40 is connected to the plurality of operation valves 55, and operation fluid (that is, pilot fluid) from the first hydraulic pump P1 can be supplied through the output fluid line 40. The plurality of operation valves 55 include an operation valve 55A, operation valve 55B, operation valve 55C, and operation valve 55D.

When the traveling operation member 59 is swung forward (that is, in one direction) in the fore-and-aft direction (that is, the first direction) (that is, when a forward operation of performed), the operation valve 55A changes a pressure of operation fluid output according to an operation extent (operation) of the forward operation. When the traveling operation member 59 is swung backward (that is, the first direction) (that is, in the other direction) in the fore-and-aft direction (that is, when a backward operation of performed), the operation valve 55B changes a pressure of operation fluid output according to an operation extent (operation) of the backward operation. When the traveling operation member 59 is swung rightward (that is, in one direction) in the lateral direction (that is, the second direction) (that is, when a rightward operation of performed), the operation valve 55C changes a pressure of operation fluid output according to an operation extent (operation) of the rightward operation. When the traveling operation member 59 is swung leftward (that is, in the other direction) in the lateral direction (that is, the second direction) (that is, when a leftward operation of performed), the operation valve 55D changes a pressure of operation fluid output according to an operation extent (operation) of the leftward operation.

The plurality of operation valves 55 and the traveling pumps (that is, the left traveling pump 53L and the right traveling pump 53R) are connected by the traveling fluid line 45. In other words, the traveling pumps (that is, the left traveling pump 53L and the right traveling pump 53R) are hydraulic equipment that are configured to be operated by operation fluid output from the operation valves 55 (that is, the operation valve 55A, operation valve 55B, operation valve 55C, and operation valve 55D).

The traveling fluid line 45 has a first traveling fluid line 45*a*, a second traveling fluid line 45*b*, a third traveling fluid line 45*c*, a fourth traveling fluid line 45*d*, and a fifth traveling fluid line 45*e*. The first traveling fluid line 45*a* is a fluid line connected to a pressure-receiving portion 53*a* (referred to as a first pressure-receiving portion) of the left traveling pump 53L, and is a fluid line through which operation fluid applied to the pressure-receiving portion 53*a* (that is, the first pressure-receiving portion) flows when the traveling operation member 59 is operated. The second traveling fluid line 45*b* is a fluid line connected to a pressure-receiving portion 53*b* (referred to as a second pressure-receiving portion) of the left traveling pump 53L, and is a fluid line through which operation fluid applied to the pressure-receiving portion 53*b* (that is, the second pressure-receiving portion) flows when the traveling operation member 59 is operated. The third traveling fluid line 45*c* is a fluid line connected to a pressure-receiving portion 53*a* (referred to as a third pressure-receiving portion) of the right traveling pump 53R, and is a fluid line through which operation fluid applied to the pressure-receiving portion 53*a* (that is, the third pressure-receiving portion) flows when the traveling operation member 59 is operated. The fourth traveling fluid line 45*d* is a fluid line connected to a pressure-receiving portion 53*b* (referred to as a fourth pressure-receiving portion) of the right traveling pump 53R, and is a fluid line through which operation fluid applied to the pressure-receiving portion 53*b* (that is, the fourth pressure-receiving portion) flows when the traveling operation member 59 is operated. The fifth traveling fluid line 45*e* is a fluid line that connects the operation valves 55, the first traveling fluid line 45*a*, the second traveling fluid line 45*b*, the third traveling fluid line 45*c*, and the fourth traveling fluid line 45*d*.

Figure 2:
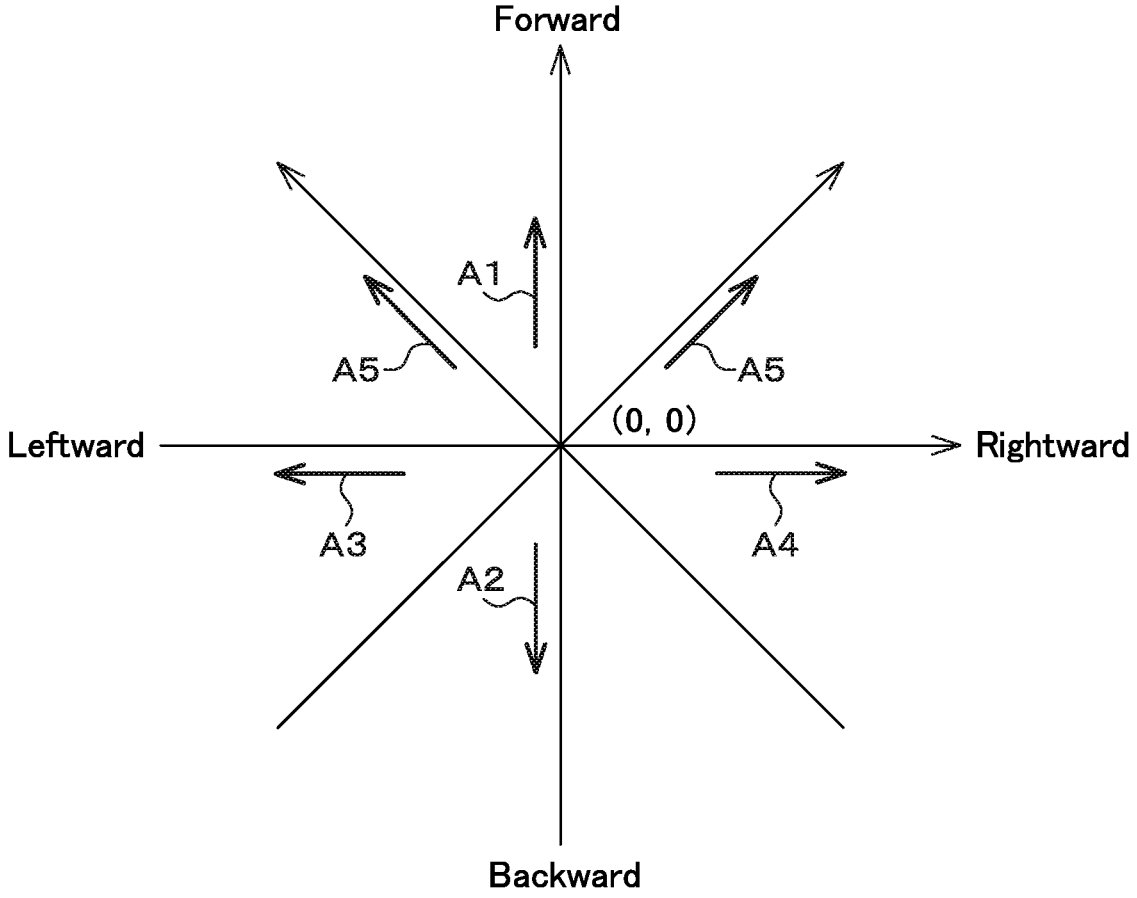
FIG. 2 is a view showing operational directions and the like of a traveling operation member.

When the traveling operation member 59 is swung forward (in a direction indicated by an arrowed line A1 in FIGS. 1 and 2), the operation valve 55A is operated and pilot pressure is output from the operation valve 55A. This pilot pressure is applied to the pressure receiver portion 53*a* of the left traveling pump 53L via the first traveling fluid line 45*a* and to the pressure receiver portion 53*a* of the right traveling pump 53R via the third traveling fluid line 45*c*. In this manner, the swash plate angles of the left traveling pump 53L and the right traveling pump 53R are changed, the left traveling motor 36L and the right traveling motor 36R rotate forwardly (referred to as forward rotation), and the working machine 1 travels straight forward.

When the traveling operation member 59 is swung backward (in a direction indicated by an arrowed line A2 in FIGS. 1 and 2), the operation valve 55B is operated and pilot pressure is output from the operation valve 55B. This pilot pressure is applied to the pressure receiver portion 53*b* of the left traveling pump 53L via the second traveling fluid line 45*b* and to the pressure receiver portion 53*b* of the right traveling pump 53R via the fourth traveling fluid line 45*d*. In this manner, the swash plate angles of the left traveling pump 53L and the right traveling pump 53R are changed, the left traveling motor 36L and the right traveling motor 36R rotate reversely (referred to as backward rotation), and the working machine 1 travels straight backward.

When the traveling control member 59 is swung to the right (in a direction indicated by an arrowed line A3 in FIGS. 1 and 2), the control valve 55C is operated and pilot pressure is output from the control valve 55C. This pilot pressure is applied to the pressure receiver portion 53*a* of the left traveling pump 53L via the first traveling fluid line 45*a*, and to the pressure receiver portion 53*b* of the right traveling pump 53R via the fourth traveling fluid line 45*d*. In this manner, the swash plate angles of the left traveling pump 53L and the right traveling pump 53R are changed, and the left traveling motor 36L rotates forwardly and the right traveling motor 36R rotates reversely, and the working machine 1 spins to turn rightward (that is, spin turn).

When the traveling control member 59 is swung to the left (in a direction indicated by an arrowed line A4 in FIGS. 1 and 2), the control valve 55D is operated and pilot pressure is output from the control valve 55D. This pilot pressure is applied to the pressure receiver portion 53*a* of the right traveling pump 53R via the third traveling fluid line 45*c*, and to the pressure receiver portion 53*b* of the left traveling pump 53L via the second traveling fluid line 45*b*. In this manner, the swash plate angles of the left traveling pump 53L and the right traveling pump 53R are changed, and the left traveling motor 36L rotates reversely and the right traveling motor 36R rotates forwardly, and the working machine 1 spins to turn leftward (that is, spin turn).

When the traveling operation member 59 is swung in an oblique direction (in a direction indicated by an arrowed line A5 in FIG. 2), rotation directions and rotation speeds of the left traveling motor 36L and the right traveling motor 36R are determined by a differential pressure between the pilot pressures applied to the pressure receiving portion 53*a* and the pressure receiving portion 53*b*, and the working machine 1 pivots to turn rightward or leftward while traveling forward or backward.

That is, when the traveling operation member 59 is swung obliquely forward to the left, the working machine 1 turns to the left while traveling forward at a speed corresponding to the swing angle of the traveling operation member 59. When the traveling operation member 59 is swung obliquely forward to the right, the working machine 1 turns to the right while traveling forward at a speed corresponding to the swing angle of the traveling operation member 59. When the traveling operation member 59 is swung obliquely backward to the left, the working machine 1 turns to the left while traveling backward at a speed corresponding to the swing angle of the traveling operation member 59. In addition, when the traveling operation member 59 is swung obliquely backward to the right, the working machine 1 turns to the right while traveling backward at a speed corresponding to the swing angle of the traveling operation member 59.

As shown in FIG. 1, the working machine 1 has a controller 60. The controller 60 performs various controls of the working machine 1 and is constituted of semiconductors such as a CPU, an MPU, electrical and electronic circuits, or the like. A mode switch 66, a speed changer switch 67, and a rotation detector 68 are connected to the controller 60.

The mode switch 66 is a switch configured to enable or disable an automatic deceleration operation (simply referred to as "automatic deceleration"). For example, the mode switch 66 is a switch capable of being switched on and off, and when being on, the mode switch 66 switches the automatic deceleration to be enabled, and when being off, the mode switch 66 switches the automatic deceleration to be disabled.

The speed changer switch 67 is provided in the vicinity of the driver seat 8 and can be operated by a driver (an operator). The speed changer switch 67 is capable of manually switching rotation speeds of the traveling motors 36L and 36R (that is, the left traveling motor 36L and right traveling motor 36R) to either the first speed or the second speed. For example, the speed changer switch 67 is a seesaw switch capable of ordering an accelerating operation for switching rotation speeds of the traveling motors 36L and 36R from the first speed to the second speed, and a decelerating operation for switching rotation speeds of the traveling motors 36L and 36R from the second speed to the first speed.

The rotation detector 68 is constituted of a sensor and the like to detect a prime mover rotation speed that is a rotation speed of the prime mover 32.

The controller 60 has an automatic decelerator 61. The automatic decelerator 61 is constituted of an electrical and electronic circuit or the like installed in the controller 60, a computer program stored in the controller 60, and the like.

The automatic decelerator 61 executes an automatic deceleration control when automatic deceleration is enabled under a traveling mode, and does not execute the automatic deceleration control when the automatic deceleration is disabled under the traveling mode.

In the automatic deceleration control, in a state where rotation speeds of the traveling motors 36L and 36R are at the second speed, the rotation speeds of the traveling motors 36L and 36R are automatically switched from the second speed to the first speed when a predetermined condition (referred to as an automatic deceleration condition) is satisfied. In the automatic deceleration control, when the automatic deceleration condition is satisfied at least in a state where the traveling motors (that is, the left traveling motor 36L and right traveling motor 36R) are at the second speed, the controller 60 demagnetizes a solenoid of the second switching valve 72 to switch the second switching valve 72 from the second position 72*b* to the first position 72*a*, and the rotation speeds of the traveling motors (that is, the left traveling motor 36L and right traveling motor 36R) are decelerated from the second speed to the first speed. That is, in the automatic deceleration control, the controller 60 decelerates the rotation speeds of both the left traveling motor 36L and the right traveling motor 36R from the second speed to the first speed when the automatic deceleration is performed.

When a predetermined return condition is satisfied after the automatic deceleration is performed, the automatic decelerator 61 magnetizes a solenoid of the second switching valve 72 to switch the second switching valve 72 from the first position 72*a* to the second position 72*b*, and accelerates rotation speeds of the traveling motors 36L and 36R from the first speed to the second speed. That is, the rotation speeds of the traveling motors 36L and 36R returns to the second speed. In other words, the controller 60 accelerates the rotation speeds of both the left traveling motor 36L and the right traveling motor 36R from the first speed to the second speed.

When the automatic deceleration is disabled, the controller 60 performs a manual switching control to switch the rotation speeds of the traveling motors 36L and 36R to either the first speed or the second speed in response to operation of the speed changer switch 67. In the manual switching control, when the speed changer switch 67 is switched to the first speed, the solenoid of the second switching valve 72 is demagnetized to set the rotation speeds of the traveling motors 36L and 36R to the first speed. In the manual switching control, when the speed changer switch 67 is switched to the second speed, the solenoid of the second switching valve 72 is demagnetized to set the rotation speeds of the traveling motors 36L and 36R to the second speed.

The controller 60 performs the automatic deceleration (a control process to automatically switch the rotation speeds of the traveling motors 36L and 36R from the second speed to the first speed) based on pressures in the circulation fluid lines 57*h* and 57*i*. A plurality of pressure detectors 80 are connected to the circulation fluid lines 57*h* and 57*i*. The plurality of pressure detectors 80 includes a first pressure detector 80*a*, a second pressure detector 80*b*, a third pressure detector 80*c*, and a fourth pressure detector 80*d*. The first pressure detector 80*a* is provided on the first passage of the circulation fluid line 57*h* connected to the first port P11 of the left traveling motor 36L, and detects the first traveling pressure LF(t) that is a pressure in the first passage of the first circulation fluid line 57*h* on the first port P11 side. The second pressure detector 80*b* is provided on the second passage of the circulation fluid line 57*h* connected to the second port P12 of the left traveling motor 36L, and detects the second traveling pressure LB(t) that is a pressure in the second passage of the first circulation fluid line 57*h* on the second port P12 side. The third pressure detector 80*c* is provided on the third passage of the second circulation fluid line 57*i* connected to the third port P13 of the right traveling motor 36R, and detects the third traveling pressure RF(t) that is a pressure in the third passage of the second circulation fluid line 57*i* on the third port P13 side. The fourth pressure detector 80*d* is provided on the fourth passage of the second circulation fluid line 57*i* connected to the fourth port P14 of the right traveling motor 36R, and detects the fourth traveling pressure RB(t) that is a pressure in the fourth passage of the second circulation fluid line 57*i* on the fourth port P14 side.

The controller 60 (the automatic decelerator 61) performs the automatic deceleration based on the first traveling pressure LF (t, rpm) detected by the first pressure detector 80*a*, the second traveling pressure LB (t, rpm) detected by the second pressure detector 80*b*, the third traveling pressure RF (t, rpm) detected by the third pressure detector 80*c*, and the fourth traveling pressure RB (t, rpm) detected by the fourth pressure detector 80*d* (t, rpm). The sign "(t, rpm)" indicated in the first traveling pressure LF (t, rpm), the second traveling pressure LB (t, rpm), the third traveling pressure RF (t, rpm), and the fourth traveling pressure RB (t, rpm) shows that the values are associated with an actual rotation speed (rpm) of the prime mover at a certain time (t).

Specifically, as shown in Equation (1), the automatic decelerator 61 performs the automatic deceleration (a process to automatically switch the rotation speed of the traveling motors 36L and 36R from the second speed that is in the high speed range to the first speed that is in the low speed range) when any one of the first traveling pressure LF (t, rpm), the second traveling pressure LB (t, rpm), the third traveling pressure RF (t, rpm), and the fourth traveling pressure RB (t, rpm) becomes equal to or higher than the deceleration threshold ST (rpm), which is determined according to the actual rotation speed of the prime mover. Equation (1) is an example of an automatic deceleration condition.

(Equation 1)

$$\begin{pmatrix} LF_{(t,rpm)} \\ LB_{(t,rpm)} \\ RF_{(t,rpm)} \\ RB_{(t,rpm)} \end{pmatrix} \geq ST(rpm) \tag{1}$$

In a state where the working machine 1 (that is, the machine body 2) is traveling, the controller 60 calculates a first cross-differential pressure x1 (t, rpm), a second cross-differential pressure x2 (t, rpm), a third cross-differential pressure x3 (t, rpm), and a fourth cross-differential pressure x4(*t*, rpm) as shown in Equation (2).

The first cross-differential pressure x1 (t, rpm) is a value obtained by subtracting the fourth traveling pressure RB (t, rpm) from the first traveling pressure LF (t, rpm), the second cross-differential pressure x2 (t, rpm) is a value obtained by subtracting the third traveling pressure RF (t, rpm) from the second traveling pressure LB (t, rpm), the third cross-differential pressure x3 (t, rpm) is a value obtained by subtracting the second traveling pressure LB (t, rpm) from the third traveling pressure RF (t, rpm), and the fourth cross-differential pressure x4 (t, rpm) is a value obtained by subtracting the first traveling pressure LF (t, rpm) from the fourth traveling pressure RB (t, rpm).

(Equation 2)

$$\text{Cross-differential pressure} = \begin{pmatrix} x3_{(t,rpm)} \\ x1_{(t,rpm)} \\ x4_{(t,rpm)} \\ x2_{(t,rpm)} \end{pmatrix} = \begin{pmatrix} RF_{(t,rpm)} - LB_{(t,rpm)} \\ LF_{(t,rpm)} - RB_{(t,rpm)} \\ RB_{(t,rpm)} - LF_{(t,rpm)} \\ LB_{(t,rpm)} - RF_{(t,rpm)} \end{pmatrix} \tag{2}$$

As shown in Equation (3), the controller 60 may be configured to calculate a first cross-differential pressure x1' (t, rpm) instead of the first cross-differential pressure x1 (t, rpm) mentioned above, a second cross-differential pressure x2' (t, rpm) instead of the second cross-differential pressure x2 (t, rpm), a third cross-differential pressure x3' (t, rpm) instead of the third cross-differential pressure x3 (t, rpm), and a fourth cross-differential pressure x4' (t, rpm) instead of the fourth cross-differential pressure x4 (t, rpm).

The first cross-differential pressure x1' (t, rpm) is a value obtained by subtracting a second value from a first value, where the first value is obtained by subtracting the second traveling pressure LB (t, rpm) from the first traveling pressure LF (t, rpm), and the second value is obtained by subtracting the third traveling pressure RF (t, rpm) from the fourth traveling pressure RB (t, rpm).

The second cross-differential pressure x2' (t, rpm) is a value obtained by subtracting a fourth value from a third value, where the third value is obtained by subtracting the first traveling pressure LF (t, rpm) from the second traveling pressure LB (t, rpm), and the fourth value is obtained by subtracting the fourth traveling pressure RB (t, rpm) from the third traveling pressure RF (t, rpm).

The third cross-differential pressure x3' (t, rpm) is a value obtained by subtracting the third value from the fourth value, where the third value is obtained by subtracting the first traveling pressure LF (t, rpm) from the second traveling pressure LB (t, rpm), and the fourth value is obtained by subtracting the fourth traveling pressure RB (t, rpm) from the third traveling pressure RF (t, rpm).

The fourth cross-differential pressure x4' (t, rpm) is a value obtained by subtracting the first value from the second value, where the first value is obtained by subtracting the second traveling pressure LB (t, rpm) from the first traveling pressure LF (t, rpm), and the second value is obtained by subtracting the third traveling pressure RF (t, rpm) from the fourth traveling pressure RB (t, rpm).

(Equation 3)

$$\text{Cross-differential pressure} = \begin{pmatrix} x3'_{(t,rpm)} \\ x1'_{(t,rpm)} \\ x4'_{(t,rpm)} \\ x2'_{(t,rpm)} \end{pmatrix} = \begin{pmatrix} (RF_{(t,rpm)} - RB_{(t,rpm)}) - (LB_{(t,rpm)} - LF_{(t,rpm)}) \\ (LF_{(t,rpm)} - LB_{(t,rpm)}) - (RB_{(t,rpm)} - RF_{(t,rpm)}) \\ (RB_{(t,rpm)} - RF_{(t,rpm)}) - (LF_{(t,rpm)} - LB_{(t,rpm)}) \\ (LB_{(t,rpm)} - LF_{(t,rpm)}) - (RF_{(t,rpm)} - RB_{(t,rpm)}) \end{pmatrix} \quad (3)$$

The controller 60 (that is, the automatic decelerator 61) determines the deceleration thresholds ST (rpm) respectively corresponding to the first traveling pressure LF (t, rpm), the second traveling pressure LB (t, rpm), the third traveling pressure RF (t. rpm), and the fourth traveling pressure RB (t. rpm) based on the first cross-differential pressure x1 (t, rpm), the second cross-differential pressure x2 (t, rpm), the third cross-differential pressure x3 (t, rpm), and the fourth cross-differential pressure x4 (t, rpm). Specifically, the controller 60 (that is, the automatic decelerator 61) determines the deceleration thresholds ST (rpm) according to Equation (4). The symbol "12(t, $r_p$m)" in Equation (4) is a correction factor. The symbols "A1(rpm)", "A2(rpm)", "A3(rpm)", and "A4(rpm)" in Equation (4) are values determined respectively for actual rotation speeds of the prime mover, such as pressures given when the four relief valves in the circulation fluid line start to operate, or pressures given when the pressures in the circulation fluid line are stabilized after the relief valves start to operate. Note that the symbols "A1(rpm)", "A2(rpm)", "A3(rpm)", and "A4(rpm)" are just examples and are not limited thereto.

(Equation 4)

$$ST(rpm) = \begin{pmatrix} A1_{(rpm)} \\ A2_{(rpm)} \\ A3_{(rpm)} \\ A4_{(rpm)} \end{pmatrix} \times \eta_2 \quad (4)$$

During the traveling, the controller 60 (automatic decelerator 61) calculates the first cross-differential pressure x1 (t, rpm), the second cross-differential pressure x2 (t, rpm), the third cross-differential pressure x3 (t, rpm), and the fourth cross-differential pressure x4 (t, rpm) based on the first traveling pressure LF (t, rpm), the second traveling pressure LB (t, rpm), the third traveling pressure RF (t, rpm), and the fourth traveling pressure RB (t, rpm), and changes the correction factor $\eta_{2(t,\ rpm)}$ for the first traveling pressure LF (t, rpm), the second traveling pressure LB (t, rpm), the third traveling pressure RF (t, rpm), and the fourth traveling pressure RB (t, rpm) respectively according to the cross-differential pressures [the first cross-differential pressure x1 (t, rpm), the second cross-differential pressure x2 (t, rpm), the third cross-differential pressure x3 (t, rpm), and the fourth cross-differential pressure x4 (t, rpm)] that are calculation results. In this manner, the controller determines the deceleration thresholds ST (rpm) respectively corresponding to the first traveling pressure LF (t, rpm), the second traveling pressure LB (t, rpm), the third traveling pressure RF (t, rpm), and the fourth traveling pressure RB (t, rpm). For example, the controller 60 (that is, the automatic decelerator 61) increases the correction factor $\eta_{2(t,\ rpm)}$ to higher values as the cross-differential pressures become smaller, and decreases the correction factor $\eta_{2(t,\ rpm)}$ to lower values as the cross-differential pressures become larger.

Figure 3:
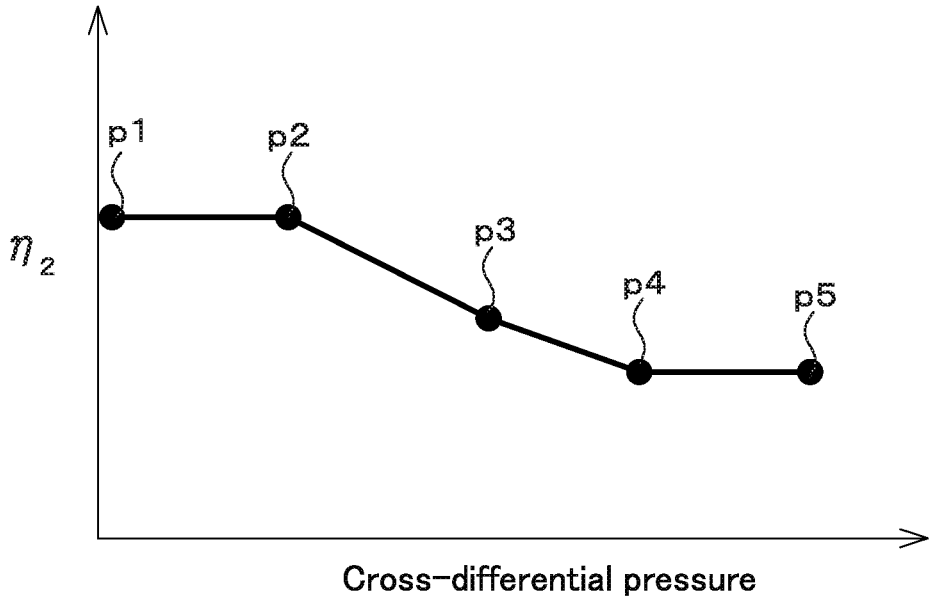
FIG. 3 is a view showing an example of transition of a relationship between a cross-differential pressure and a correction factor $\eta_{2(t,\ rpm)}$.

FIG. 3 shows a relationship between the cross-differential pressures and the correction factor $\eta_{2(t,\ rpm)}$. To explain the time points p1 to p5 shown in FIG. 3 in detail, a section from the time point p1 to the time point p2 is in an initial state where the working machine 1 is traveling straight or where the working machine 1 transits to pivot to turn from the straight traveling, and a difference between a rotation speed of the left traveling motor 36L and a rotation speed of the right traveling motor 36R is zero or relatively close to zero, and thus the cross-differential pressures are small.

A section from the time point p2 to the time point p3 is in a state where the working machine 1 performs a pivot turn, a rotation speed of one of the traveling motors (outside of the turn) is relatively high, and the rotation speed of the other one (inside of the turn) is medium. Accordingly, the cross-differential pressures are larger than those in the section between time points p1 and p2.

The section from the time point p3 to the time point p4 is in a state where the working machine 1 is pivoting to turn, a rotation speed of one of the traveling motors (outside of the turn) is relatively high, and the rotation speed of the other one (inside of the turn) is relatively low or zero. Accordingly, the cross-differential pressures are larger than those in the section between time points p2 and p3.

The section from the time point p4 to the time point p5 is in a state where the working machine 1 starts to pivot to turn from a stopping state, and a rotation speed of one of the traveling motors (outside of the turn) is increased (that is, accelerated), and the cross-differential pressures are larger than those in the sections between the time points p3 and p4.

When the working machine 1 spins to turn, the cross-differential pressures are close to zero and have the values around the time point p1.

The controller 60 (that is, the automatic decelerator 61) estimates a traveling state of the working machine 1, such as the straight traveling, the pivot turn from the straight traveling, continuation of the pivot turn, and the pivot turn from the stopping, according to magnitudes of the cross-differential pressures. Then, the controller 60 changes the correction factor $\eta_{2(t,\ rpm)}$ according to the estimated traveling state, that is, the cross-differential pressures.

Specifically, when the cross-differential pressures are small, that is, when determining that the working machine 1 is traveling straight or pivoting to turn (at the time point p1), the automatic decelerator 61 increases the correction factor $\eta_{2(t,\ rpm)}$ to increase a value of the deceleration threshold ST (rpm).

In addition, in a case where the cross-differential pressures are relatively small, that is, when determining that the working machine 1 starts to pivot to turn from the straight raveling (at the time point p2), the automatic decelerator 61 sets the correction factor $\eta_{2(t,\ rpm)}$ to the same value as that at point p1.

When the cross-differential pressures are middle, that is, when determining that the working machine 1 is pivoting to turn, and a rotation speed of one of the traveling motors 36L and 36R is relatively high and a speed of the other traveling motor is middle (at the time point p3), the automatic decelerator 61 sets the correction factor $\eta_{2(t,\ rpm)}$ to be lower than those at the time points P1 and P2.

Then, when the cross-differential pressures are relatively large, that is, when the working machine 1 is pivoting to turn, and a rotation speed of one of the traveling motors is increased (that is, accelerated) and a rotation speed of the other traveling motor is relatively low or zero (at the time points p4 and p5), the automatic decelerator 61 sets the correction factor 12 lower than that at the time point p3 to decrease a value of the deceleration threshold ST (rpm).

The controller 60 (that is, the automatic decelerator 61) estimates a traveling state of the working machine 1, such as the straight traveling, the pivot turn from the straight traveling, continuation of the pivot turn, and the pivot turn from the stopping, according to magnitudes of the cross-differential pressures. Then, the controller 60 increases or decreases the correction factor $\eta_{2(t,\ rpm)}$ according to the estimated traveling state, that is, the cross-differential pressures, thereby changing the deceleration threshold ST (rpm).

Accordingly, the automatic decelerator 61 sets the correction factor $\eta_{2(t,\ rpm)}$ to be large since the cross-differential pressure is relatively low, thereby prevention the controller 60 (that is, the automatic decelerator 61) from unexpectedly starting the automatic deceleration control, in a state where the working machine 1 is traveling straight or starts to pivot to turn from the straight traveling (at the time point p1 and the time point p2), that is, where the rotation speeds of the traveling motors (that is, the left traveling motor 36L and the right traveling motor 36R) are relatively close and a relatively-large traveling torque is not required, or in a case where one of the traveling motors (outside of the turn) pulls the other one of the traveling motors (inside of the turn) due to the inertia of the working machine 1 when starting to pivot to turn from the straight traveling, thus a relatively-large braking torque is applied to the traveling motor provided inside of the turn.

The automatic decelerator 61 sets the correction factor $\eta_{2(t,\ rpm)}$ to be middle, and accordingly the controller 60 (that is, the automatic decelerator 61) is capable of adequately starting the automatic deceleration control, in a state where the working machine 1 is pivoting to turn, the rotation speed of one of the traveling motors 36L and 36R (outside of the turn) is relatively high, the rotation speed of the other one of the traveling motors (inside of the turn) is higher than a middle speed, one of the traveling devices 5L and 5R is pulled, and accordingly a relatively-high traveling torque is required (in the section from the time point p3 to the time point p4).

Since the cross-differential pressure is relatively high, the automatic decelerator 61 sets the correction factor $\eta_{2(t,\ rpm)}$ to be small, accordingly the controller 60 (that is, the automatic decelerator 61) is capable of more adequately starting the automatic deceleration control, in a case where the working machine 1 starts to pivot to turn from the stopping state, a relatively-large traveling torque is required since a rotation speed of one of the traveling motors (outside of the turn) is increased (that is, accelerated), a rotation speed of the other one of the traveling motors (inside of the turn) is relatively low or zero, and a braking torque applied to the traveling motor provided inside the turn is small.

The above-mentioned braking torque is a force to brake the rotation of the other traveling motor because of increasing a pressure in the fluid line for rotating the other traveling motor that is in the opposite direction to the rotation of the one traveling motor (for example, the other traveling motor rotates for the backward traveling in a case where the one traveling motor rotates for the forward traveling).

In the present embodiment, the automatic deceleration is variably started depending on a combination of magnitude of a traveling pressure of the one traveling motor and magnitude of a braking torque of the other traveling motor.

In the above-described embodiment, the controller 60 (that is, the automatic decelerator 61) acquires the deceleration threshold ST (rpm) by multiplying the pressures corresponding to the A1 (rpm), the A2 (rpm), the A3(rpm), and the A4(rpm) by the correction factor $\eta_{2(t,\ rpm)}$, as shown in Equation (4); alternatively, the controller 60 (that is, the automatic decelerator 61) may acquire the deceleration threshold ST (rpm) by adding or subtracting the correction factor $\eta_{3(t,\ rpm)}$ to or from the A1 (rpm), the A2 (rpm), the A3(rpm), and the A4(rpm) instead of the correction factor $\eta_{2(t,\ rpm)}$. For example, the correction pressure $\eta_{3(t,\ rpm)}$ can be determined by the cross-differential pressures corresponding to the time points p1 to p5, as shown in FIG. 4A.

Figure 4B:
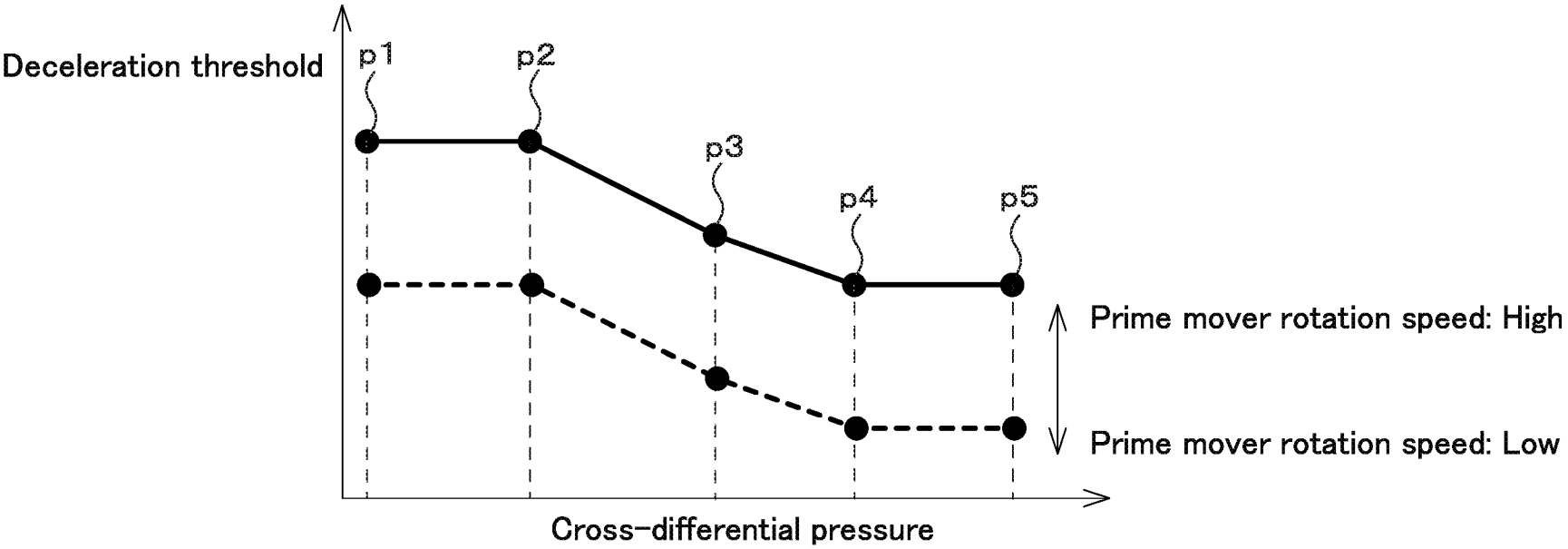
FIG. 4B is a view showing a relationship between the cross-differential pressure and a deceleration threshold ST according to a first modified example.

The controller 60 (that is, the automatic decelerator 61) may determine the deceleration threshold ST (rpm) based on a predetermined map shown in FIG. 4B, without depending on the A1 (rpm), A2 (rpm), A3 (rpm), A4 (rpm) and the correction factor $\eta_{2(t,\ rpm)}$ of Equation (4) or on the correction pressure $\eta_{3(t,\ rpm)}$. The map is stored in a storage portion of the controller 60 (that is, the automatic decelerator 61) in advance, and the automatic decelerator 61 refers to the map in the storage portion to determine the deceleration threshold ST (rpm) corresponding to each of the first cross-differential pressure x1 (t, rpm), second cross-differential pressure x2 (t, rpm), third cross-differential pressure x3 (t, rpm), and fourth cross-differential pressure x4(*t*, rpm). In this case, as shown in FIG. 4B, the deceleration threshold ST (rpm) is determined according to an actual rotation speed of the prime mover. Specifically, when the actual rotation speed of the prime mover increases, the deceleration threshold ST (rpm) is set relatively higher, and when the actual rotation speed of the prime mover decreases, the deceleration threshold ST (rpm) is set relatively lower.

In this embodiment, the deceleration threshold ST (rpm) is determined according to the actual rotation speed of the prime mover, and the A1(rpm), A2(rpm), A3(rpm), and A4(rpm) are values determined for each actual rotation speed of the prime mover, however, the deceleration threshold ST' (rpm) may be determined according to a target rotation speed in the control of the prime mover, that is, the A1(rpm), A2(rpm), A3(rpm), and A4(rpm) may be determined for each target rotation speed of the prime mover, and thus the automatic decelerator 61 may be configured to start the automatic deceleration when any one of the first traveling pressure LF (t, rpm), the second traveling pressure LB (t, rpm), the third traveling pressure RF (t, rpm), and the fourth traveling pressure RB (t, rpm) becomes equal to or higher than the deceleration threshold ST (rpm) determined according to the target rotation speed of the prime mover.

In this case, when the controller 60 (that is, the automatic decelerator 61) determines that an actual rotation speed of the prime mover is deviated from a target rotation speed by a predetermined amount, the controller 60 may start the automatic deceleration control based on the deceleration threshold ST (rpm) determined according to the actual rotation speed, instead of the deceleration threshold ST' (rpm) determined according to the target rotation speed.

In the above-mentioned embodiment, as shown in Equation (1), the first traveling pressure LF (t, rpm), the second traveling pressure LB (t, rpm), the third traveling pressure RF (t, rpm), and the fourth traveling pressure RB (t, rpm) are compared to the deceleration threshold ST (rpm); however, the automatic deceleration may be started by comparing the deceleration threshold ST (rpm) to effective differential pressures [the first differential pressure b (t, rpm), the second differential pressure d (t, rpm), the third differential pressure a (t, rpm), the fourth differential pressure c (t, rpm)] shown in Equation (5). Alternatively, the automatic deceleration may be started by comparing the deceleration threshold ST (rpm) to the cross-differential pressures [the first cross-differential pressure x1 (t, rpm), the second cross-differential pressure x2 (t, rpm), the third cross-differential pressure x3 (t, rpm), the fourth cross-differential pressure x4 (t, rpm)].

(Equation 5)

$$\begin{pmatrix} a_{(t,rpm)} \\ b_{(t,rpm)} \\ c_{(t,rpm)} \\ d_{(t,rpm)} \end{pmatrix} = \begin{pmatrix} RF_{(t,rpm)} - RB_{(t,rpm)} \\ LF_{(t,rpm)} - LB_{(t,rpm)} \\ RB_{(t,rpm)} - RF_{(t,rpm)} \\ LB_{(t,rpm)} - LF_{(t,rpm)} \end{pmatrix} \quad (5)$$

The controller 60 (that is, the automatic decelerator 61) may start the deceleration with reference to the cross-differential pressures when a specific operation is detected. For example, the deceleration threshold may be determined with reference to the cross-differential pressures as described above when an operation of the pivot turn is performed. In this case, for example, the operation of the operation lever 59 may be detected by a potentiometer or the like, or based on pressures of the operation valves 55 (that is, the operation valves 55A, 55B, 55C, and 55D). In the case of detecting the pressures of the operating valves 55, as shown in FIG. 1, the first traveling fluid line 45*a* is provided with a first pressure detector 48*a* configured to detect a pressure of the operation fluid in the first traveling fluid line 45*a*, and the second traveling fluid line 45*b* is provided with a second pressure detector 48*b* configured to detect a pressure of the operation fluid in the second traveling fluid line 45*b*. In addition, the third traveling fluid line 45*c* is provided with a third pressure detector 48*c* configured to detect a pressure of the operation fluid in the third traveling fluid line 45*c*, and the fourth traveling fluid line 45*d* is provided with a fourth pressure detector 48*d* configured to detect a pressure of the operation fluid in the fourth traveling fluid line 45*d*.

In the traveling fluid lines 45, throttles 95*a*, 95*b*, 95*c*, and 95*d* are provided on downstream sides of the first pressure detector 48*a*, the second pressure detector 48*b*, the third pressure detector 48*c*, and the fourth pressure detector 48*d*. In detail, the throttle 95*a* is provided downstream of the first pressure detector 80*a* (near the traveling pump) in the first traveling fluid line 45*a*, the throttle 95*b* is provided downstream of the second pressure detector 80*b* (near the traveling pump) in the second traveling fluid line 45*b*, the throttle 95*c* is provided downstream of the third pressure detector 80*c* (near the traveling pump) in the third traveling fluid line 45*c*, and the throttle 95*d* is provided downstream of the third pressure detector 80*d* (near the traveling pump) in the third traveling fluid line 45*d*. In other words, the first pressure detector 48*a*, the second pressure detector 48*b*, the third pressure detector 48*c*, and the fourth pressure detector 48*d* are respectively provided between the operation device 54 and the throttles 95*a*, 95*b*, 95*c*, and 95*d*. Accordingly, the pilot pressure output from the operation device 54 can be accurately detected by the first pressure detector 48*a*, the second pressure detector 48*b*, the third pressure detector 48*c*, and the fourth pressure detector 48*d*.

Figure 5A:
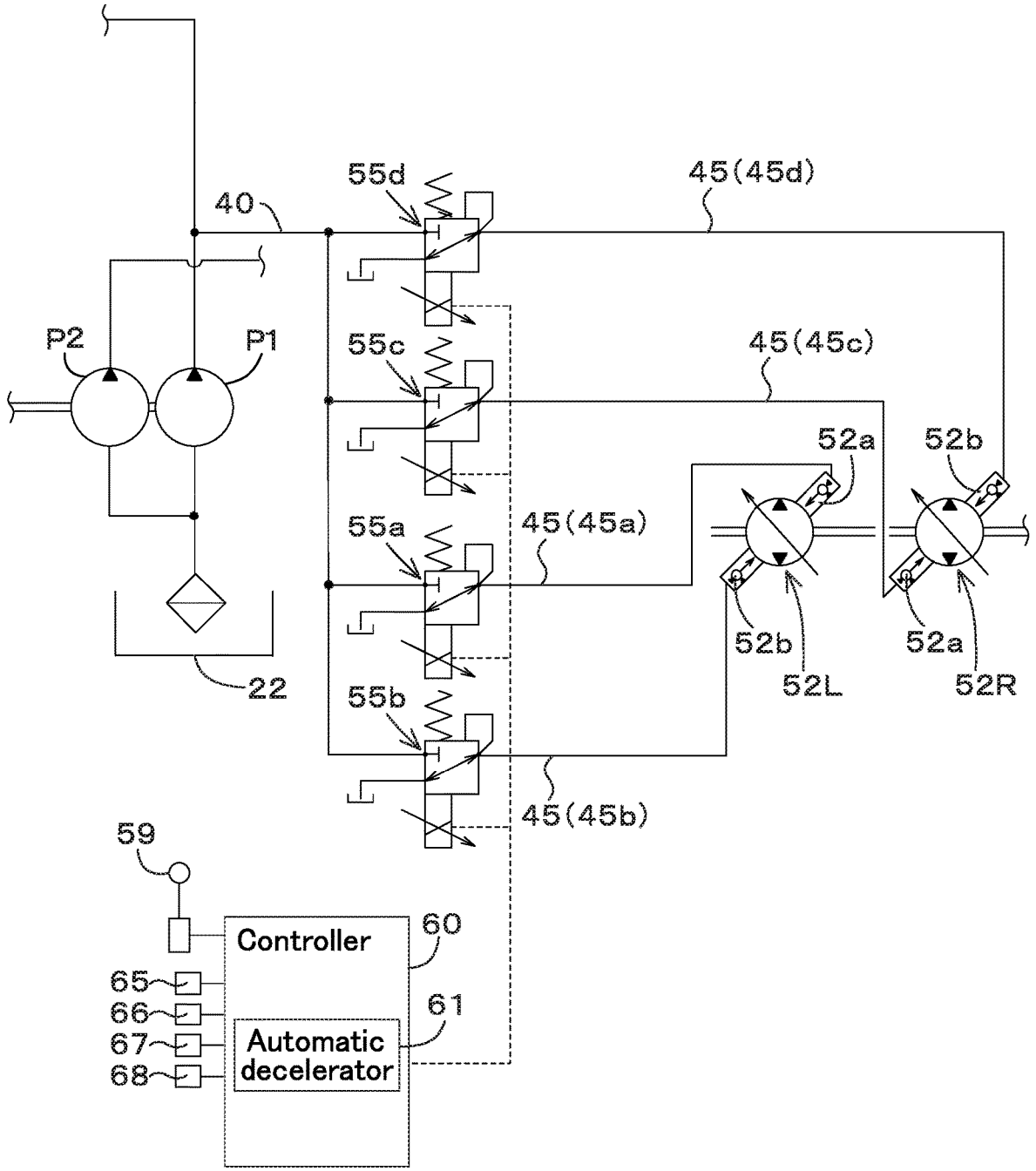
FIG. 5A is a view showing a hydraulic system (a hydraulic circuit) for a working machine according to a second modified example.

As shown in FIG. 5A, in the operation device (that is, the traveling operation device) 54, the operation valves 55 (that is, the operation valves 55A, 55B, 55C, and 55D) are constituted of solenoid proportional valves, and the controller 60 operates the operation valves 55 (that is, the operation valves 55A, 55B, 55C, and 55D) according to an operation extent and operational direction of the operation lever 59. The controller 60 detects the operation of the operation lever 59 with a detector such as a potentiometer and determines pilot pressures output from the operation valves 55 (that is, the operation valves 55A, 55B, 55C, and 55D) based on the operation extent.

Figure 5B:
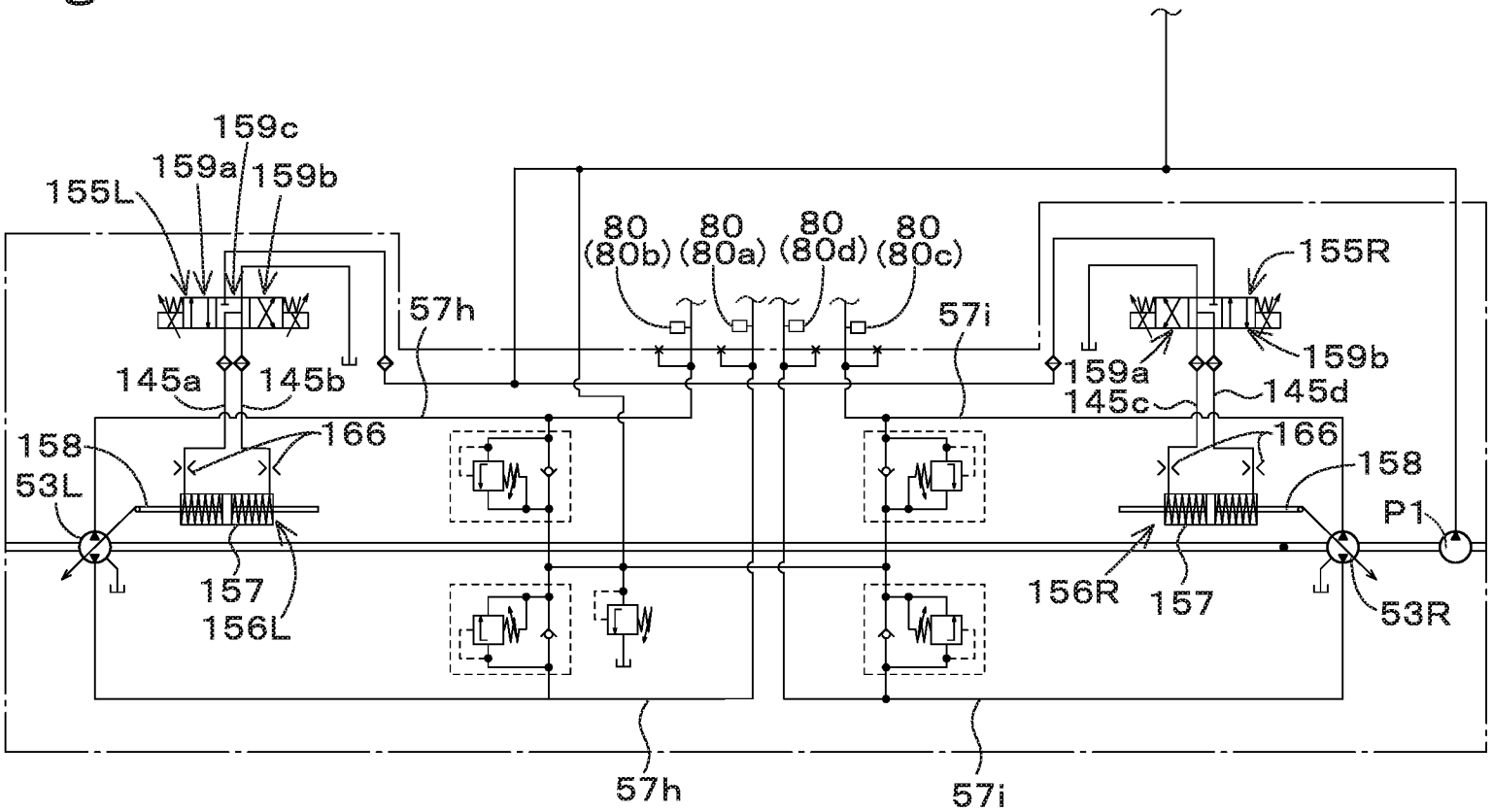
FIG. 5B is a view showing a hydraulic system (a hydraulic circuit) for a working machine according to a third modified example.

As shown in FIG. 5B, the traveling hydraulic circuit may be modified in the hydraulic system for the working machine. As shown in FIG. 5B, the traveling pumps (that is, the left traveling pump 53L and the right traveling pump 53R) respectively include hydraulic regulators 156L and 156R. Each of the hydraulic regulators 156L and 156R is capable of changing an angle of the swash plate (that is, a swash plate angle) of each of the traveling pumps (that is, the left traveling pump 53L and the right traveling pump 53R), and includes a supply chamber 157 to which operation fluid can be supplied and a piston rod 158 provided in the supply chamber 157. The piston rod 158 is connected to the swash plate, and the swash plate angle can be changed by movement of the piston rod 158.

The operation valve 155L is a valve for operating the hydraulic regulator 156L, that is, a valve for controlling operation fluid to be supplied to the left traveling pump 53L. The operation valve 155L is a solenoid proportional valve that has a spool to be moved based on a control signal output to a solenoid 160L from the controller 60 and is configured to change an opening degree thereof through movement of the spool. The operation valve 155L has a first position 159*a*, a second position 159*b*, and a neutral position 159*c* and is switchable among them.

A first port of the operation valve 155L is connected to the supply chamber 157 of the hydraulic regulator 156L by a first traveling fluid line 145*a*. A second port of the operation valve 155L is connected to the supply chamber 157 of the hydraulic regulator 156L by a second traveling fluid line 145*b*.

The operation valve 155R is a valve for operating the hydraulic regulator 156R, that is, a valve for controlling operation fluid to be supplied to the right traveling pump 53R. The operation valve 155R is a solenoid proportional valve that has a spool to be moved based on a control signal output to a solenoid 160R from the controller 60 and is configured to change an opening degree thereof through movement of the spool. The operation valve 155R has a first position 159*a*, a second position 159*b*, and a neutral position 159*c* and is switchable among them.

A first port of the operation valve 155R is connected to the supply chamber 157 of the hydraulic regulator 156R by a third traveling fluid line 145*c*. A second port of the operation valve 155R is connected to the supply chamber 157 of the hydraulic regulator 156R by a fourth traveling fluid line 145*d*.

When the operation valve 155L and the operation valve 155R are each set at the first position 159*a*, the left and right traveling pumps 53L and 53R each delivers operation fluid in one direction to rotate each of the left and right traveling motors 36L and 36R in a normal direction. When the operation valve 155L and the operation valve 155R are each set at the second position 159*b*, the left and right traveling pumps 53L and 53R each delivers operation fluid in the other direction to rotate each of the left and right traveling motors 36L and 36R in a reverse direction. When the operation valve 155L is set at the first position 159*a* and the operation valve 155R is set at the second position 159*b*, the left traveling pump 53L delivers operation fluid in the direction to rotate the left traveling motor 36L in the normal direction and the right traveling pump 53R delivers operation fluid in the direction to rotate the right traveling motor 36R in the reverse direction. When the operation valve 155L is set at the second position 159*b* and the operation valve 155R is set at the first position 159*a*, the left traveling pump 53L delivers operation fluid to rotate the left traveling motor 36L in the reverse direction and the right traveling pump 53R delivers operation fluid to rotate the right traveling motor 36R in the normal direction.

The working machine 1 includes the machine body 2, the prime mover 32 provided on the machine body 2, the left traveling device 5L provided on the right portion of the machine body 2, the right traveling device 5R provided on the right portion of the machine body 2, the left traveling motor 36L configured to output power to the left traveling device 5L and to be rotated at the speed stage shiftable between the first speed and the second speed higher than the first speed, the right traveling motor 36R configured to output power to the right traveling device 5R and to be rotated at the speed stage shiftable between the first speed and the second speed higher than the first speed, the left traveling pump 53L to supply operation fluid to the left traveling motor 36L, the right traveling pump 53R to supply operation fluid to the right traveling motor 36R, the first circulation fluid line 57*h* fluidly connecting the left traveling pump 53L to the left traveling motor 36L, the first circulation fluid line 57*h* including the first passage connecting the first port 82*a* of the left traveling pump 53L to the first port P11 of the left traveling motor 36L and including the second passage connecting the second port 82*b* of the left traveling pump 53L to the second port P12 of the left traveling motor 36L, the second circulation fluid line 57*i* fluidly connecting the right traveling pump 53R to the right traveling motor 36R, the second circulation fluid line 57*i* including the third passage connecting the third port 82*c* of the right traveling pump 53L to the third port P13 of the right traveling motor 36R and the fourth passage connecting the fourth port 82*d* of the right traveling pump 53R to the fourth port P14 of the right traveling motor 36R, the first pressure detector 80*a* provided on the first passage of the first circulation fluid line 57*h* and configured to detect the first traveling pressure that is the pressure of operation fluid applied to the first passage of the first circulation fluid line 57*h* when the left traveling motor 36L rotates, the second pressure detector 80*b* provided on the second passage of the second circulation fluid line 57*i* and configured to detect the second traveling pressure that is the pressure of operation fluid applied to the second passage of the first circulation fluid line 57*h* when the left traveling motor 36L rotates, the third pressure detector 80*c* provided on the third passage of the second circulation fluid line 57*i* and configured to detect the third traveling pressure that is the pressure of operation fluid applied to the third passage of the second circulation fluid line 57*i* when the right traveling motor 36R rotates, the fourth pressure detector 80*d* provided on the fourth passage of the second circulation fluid line 57*i* and configured to detect the fourth traveling pressure that is the pressure of operation fluid applied to the fourth passage of the second circulation fluid line 57*i* when the right traveling motor 36R rotates, and the controller 60 to perform the automatic deceleration operation to automatically decelerate the left traveling motor 36L and the right traveling motor 36R each rotated a the second speed by shifting the speed of rotation of each of the left and right traveling motors 36L and 36R from the second speed to the first speed when the value calculated based on the first traveling pressure, the second traveling pressure, the third traveling pressure, and the fourth traveling pressure becomes equal to or more than a deceleration threshold. The controller 60 determines the deceleration threshold based on any one of a first cross-differential pressure acquired by subtracting the fourth traveling pressure from the first traveling pressure, a second cross-differential pressure acquired by subtracting the third traveling pressure from the second traveling pressure, a third cross-differential pressure acquired by subtracting the second traveling pressure from the third traveling pressure, and a fourth cross-differential pressure acquired by subtracting the first traveling pressure from the fourth traveling pressure.

According to this configuration, the traveling state of the working machine 1 (that is, the machine body 2) can be estimated, without detecting operation of the traveling operation member 59 or the like, by watching transitions of, i.e., changes of the cross-differential pressures during the traveling of the working machine 1 (that is, the machine body 2) or the like, and accordingly the automatic deceleration can be easily performed or not performed based on the traveling state of the working machine 1 by determining the deceleration threshold for automatic deceleration based on the estimated traveling state.

The controller 60 decreases the deceleration threshold according to increase of any one of cross-differential pressures consisting of the first cross-differential pressure, the second cross-differential pressure, the third cross-differential pressure, and the fourth cross-differential pressure, and increases the deceleration threshold according to decrease of the one of the cross-differential pressures. According to this configuration, when the cross-differential pressure is small in the pivot turn, a traveling speed (that is, a vehicle speed) is high, and the vehicle is pivoting to turn at a high speed, so the automatic deceleration can be suppressed by increasing the deceleration threshold. On the other hand, when the cross-differential pressure is large, a traveling speed of the machine body 2 is low, and the traveling motor is being accelerated, so the automatic deceleration can be facilitated by decreasing the deceleration threshold.

The controller 60 determines the deceleration threshold according to a rotation speed of the prime mover. According to this configuration, the automatic deceleration can be performed according to a rotation speed of the prime mover, that is, according to a load on the prime mover.

In the above-described embodiment, the left traveling motor 36L and the right traveling motor 36R are simultaneously shiftable between the first speed and the second speed, and the automatic deceleration operation is also performed simultaneously on the left traveling motor 36L and the right traveling motor 36R; however, the automatic deceleration may be performed under a state where at least one of the left traveling motor 36L and the right traveling motor 36R is at the first speed, and the other is at the second speed.

The traveling motors (that is, the left traveling motor 36L and the right traveling motor 36R) may be constituted of axial piston motors or radial piston motors. Regardless of whether the traveling motors are constituted of the axial piston motors or the radial piston motor, the traveling motors can be switched to the first speed by increasing a motor displacement, and can be switched to the second speed by decreasing the motor displacement.

In the above-described embodiment, the controller 60 is capable of calculating the first cross-differential pressure x1 (t, rpm), the second cross-differential pressure x2 (t, rpm), the third cross-differential pressure x3 (t, rpm), and the fourth cross-differential pressure x4 (t, rpm) as shown in Equation (2) in a state where the working machine 1 (that is, the machine body 2) is traveling, determining the deceleration threshold ST (rpm) based on any one of them, and estimating the traveling state of the working machine 1

(machine body 2). Instead of or in addition to this configuration, the controller 60 may judge whether the working machine 1 is turning or not based on the first traveling pressure LF (t, rpm), the second traveling pressure LB (t, rpm), the third traveling pressure RF (t, rpm), the fourth traveling pressure RB (t, rpm) (t, rpm), and a turn threshold Z1 (rpm). Specifically, as shown in Equation (6), the automatic decelerator 61 performs the automatic deceleration (a process to automatically switch rotation speeds of the traveling motors 36R and 36L from the second speed to the first speed that is lower than the second speed) when at least one of the first traveling pressure LF (t, rpm), the second traveling pressure LB (t, rpm), the third traveling pressure RF (t, rpm), and the fourth traveling pressure RB (t, rpm) is equal to or higher than the turn threshold (referred to as a first threshold) Z1 (rpm). Equation (6) is an example of the automatic deceleration condition different from Equation (1).

(Equation 6)

$$\begin{pmatrix} LF_{(t,rpm)} \\ LB_{(t,rpm)} \\ RF_{(t,rpm)} \\ RB_{(t,rpm)} \end{pmatrix} \geq Z1(rpm) \tag{6}$$

Then, the controller 60 judges whether the working machine 1 is turning or not based on the first traveling pressure LF (t, rpm), the second traveling pressure LB (t, rpm), the third traveling pressure RF (t, rpm), the fourth traveling pressure RB (t, rpm), and the turn threshold Z1(rpm).

During the traveling of the working machine 1, the controller 60 refers to the first traveling pressure LF (t, rpm), the second traveling pressure LB (t, rpm), the third traveling pressure RF (t, rpm), and the fourth traveling pressure RB (t, rpm). Then, as shown in Equation (7), the controller 60 calculates a first left-right differential pressure ΔZa acquired by subtracting the third traveling pressure RF (t, rpm) from the first traveling pressure LF (t, rpm), a second left-right differential pressure ΔZb acquired by subtracting the first traveling pressure LF (t, rpm) from the third traveling pressure RF (t, rpm), a third left-right differential pressure ΔZc acquired by subtracting the fourth traveling pressure RB (t, rpm) from the second traveling pressure LB (t, rpm), and a fourth left-right differential pressure ΔZd acquired by subtracting the second traveling pressure LB (t, rpm) from the fourth traveling pressure RB (t, rpm).

(Equation 7)

$$\begin{pmatrix} \Delta Zb \\ \Delta Za \\ \Delta Zd \\ \Delta Zc \end{pmatrix} = \begin{pmatrix} RF_{(t,rpm)} - LF_{(t,rpm)} \\ LF_{(t,rpm)} - RF_{(t,rpm)} \\ RB_{(t,rpm)} - LB_{(t,rpm)} \\ LB_{(t,rpm)} - RB_{(t,rpm)} \end{pmatrix} \tag{7}$$

The controller 60 quantifies a balance between the left traveling motor 36L and the right traveling motor 36R in the normal rotations based on the first left-right differential pressure ΔZa acquired by subtracting the third traveling pressure RF (t, rpm) from the first traveling pressure LF (t, rpm) and the second left-right differential pressure ΔZb acquired by subtracting the first traveling pressure LF (t, rpm) from the third traveling pressure RF (t, rpm). In addition, the controller 60 also quantifies a balance between the left traveling motor 36L and the right traveling motor 36R in the reverse rotations based on the third left-right differential pressure ΔZc acquired by subtracting the fourth traveling pressure RB (t, rpm) from the second traveling pressure LB (t, rpm) and the fourth left-right differential pressure ΔZd acquired by subtracting the second traveling pressure LB (t, rpm) from the fourth traveling pressure RB (t, rpm).

The controller 60 judges whether the machine body 2 (that is, the working machine 1) is turning or not based on the first left-right differential pressure ΔZa, the second left-right differential pressure ΔZb, the third left-right differential pressure ΔZc, and the fourth left-right differential pressure ΔZd.

For example, when the first left-right differential pressure ΔZa is higher than the predetermined turn threshold Z1 (rpm), the controller 60 determines that a normally rotational pressure on the left traveling motor 36L is high and determines that the working machine 1 (the machine body 2) is pivoting to turn forwardly rightward. In addition, when the second left-right differential pressure ΔZb is higher than the turn threshold Z1 (rpm), the controller 60 determines that a normally rotational pressure on the right traveling motor 36R is high and determines that the working machine 1 (the machine body 2) is pivoting to turn forwardly leftward.

In addition, when the third left-right differential pressure ΔZb is higher than the predetermined turn threshold Z1 (rpm), the controller 60 determines that a reversely rotational pressure on the left traveling motor 36L is high and determines that the working machine 1 (the machine body 2) is pivoting to turn backwardly rightward. In addition, when the fourth left-right differential pressure ΔZd is higher than the turn threshold Z1 (rpm), the controller 60 determines that a reversely rotational pressure on the right traveling motor 36R is high and determines that the working machine 1 (the machine body 2) is pivoting to turn backwardly leftward.

The controller 60 may determine a state of the working machine 1 (that is, the machine body 2) based on magnitudes of the first left-right differential pressure ΔZa, the second left-right differential pressure ΔZb, the third left-right differential pressure ΔZc, and the fourth left-right differential pressure ΔZd. For example, the controller 60 determines that a tendency for the working machine 1 (that is, the machine body 2) to pivot to turn forwardly rightward becomes higher as the first left-right differential pressure ΔZa becomes higher. In addition, as the second left-right differential pressure ΔZb becomes higher, it is judged that a tendency for the working machine 1 (that is, the machine body 2) to pivot to turn forwardly leftward becomes higher.

In this manner, the controller 60 can judge whether the working machine 1 (that is, the machine body 2) is turning or not based on the first left-right differential pressure ΔZa, the second left-right differential pressure ΔZb, the third left-right differential pressure ΔZc, and the fourth left-right differential pressure ΔZd that are acquired in Equation (7).

The controller 60 uses, for starting the automatic deceleration, the judgment result as to whether the working machine 1 (that is, the machine body 2) is turning or not. In addition, the controller 60 may display the judgment result as to whether the working machine 1 is turning or not on a display device mounted on the working machine 1, or may inform, by a buzzer, lamp, or the like, that the working machine 1 is turning.

The controller 60 determines the turn threshold Z1 (rpm) based on a first traveling relief pressure w1 of the first relief valve 81*a*, the second traveling relief pressure w2 of the second relief valve 81*b*, the third traveling relief pressure w3 of the third relief valve 81*c*, and the fourth traveling relief pressure w4 of the fourth relief valve 81*d*. For example, the controller 60 determines the turn threshold Z1 (rpm) based on a correction factor al and each of the first traveling relief pressure w1, the second traveling relief pressure w2, the third traveling relief pressure w3, and the fourth traveling relief pressure w4.

The traveling relief pressure is a pressure of operation fluid generated when the first relief valve 81*a*, the second relief valve 81*b*, the third relief valve 81*c*, and the fourth relief valve 81*d* are activated, or a pressure of operation fluid generated when the first relief valve 81*a*, the second relief valve 81*b*, the third relief valve 81*c*, and the fourth relief valve 81*d* are stabilized after being activated.

The controller 60 enters an acquisition mode through a predetermined operation. When the controller 60 enters the acquisition mode, the controller 60 first obtains the first traveling relief pressure w1, the second traveling relief pressure w2, the third traveling relief pressure w3, and the fourth traveling relief pressure w4 at predetermined the prime mover rotation speeds while changing a rotation speed of prime mover. Then, the controller 60 determines the turn threshold Z1 (rpm) according to the traveling relief pressures w1 to w4 determined corresponding to the prime mover rotation speeds.

For convenience of explanation, the first traveling relief pressure w1 is referred to as the first traveling relief pressure w1 (rpm), the second traveling relief pressure w2 is referred to as the second traveling relief pressure w2 (rpm), the third traveling relief pressure w3 is referred to as the third traveling relief pressure w3 (rpm), and the fourth traveling relief pressure w4 is referred to as the fourth traveling relief pressure w4 (rpm).

In determination of the turn threshold Z1 (rpm), the controller 60 refers to the first traveling relief pressure w1 (rpm), the second traveling relief pressure w2 (rpm), the third traveling relief pressure w3 (rpm), and the fourth traveling relief pressure w4 (rpm) as shown in Equation (8). In addition, a sign "α1" in Equation (8) is a correction factor. As shown in Equation (8), the controller 60 determines the turn threshold Z1 (rpm) by multiplying the respective differential pressures between the first traveling relief pressure w1 (rpm), the second traveling relief pressure w2 (rpm), the third traveling relief pressure w3 (rpm), and the fourth traveling relief pressure w4 (rpm) by the correction factor α1.

(Equation 8)

$$Z1(rpm) = \begin{pmatrix} w3_{(rpm)} - w4_{(rpm)} \\ w1_{(rpm)} - w2_{(rpm)} \\ w4_{(rpm)} - w3_{(rpm)} \\ w2_{(rpm)} - w1_{(rpm)} \end{pmatrix} \times \alpha 1 \tag{8}$$

In more detail, in the acquisition mode of the working machine 1, the controller 60 sets the prime mover rotation speed to a predetermined rotation speed. A measurement device 69 (see FIG. 1) measures the first traveling relief pressure w1 (rpm), the second traveling relief pressure w2 (rpm), the third traveling relief pressure w3 (rpm), and the fourth traveling relief pressure w4 (rpm) at the predetermined the prime mover rotation speeds.

As shown in Equation (9), the controller 60 may determine the turn threshold Z1 (rpm) based on a reference value β1, the first traveling relief pressure w1 (rpm), the second traveling relief pressure w2 (rpm), the third traveling relief pressure w3 (rpm), the fourth traveling relief pressure w4 (rpm), and a correction factor α2.

(Equation 9)

$$Z1(rpm) = \beta 1 \pm \begin{pmatrix} w3_{(rpm)} - w4_{(rpm)} \\ w1_{(rpm)} - w2_{(rpm)} \\ w4_{(rpm)} - w3_{(rpm)} \\ w2_{(rpm)} - w1_{(rpm)} \end{pmatrix} \times \alpha 2 \tag{9}$$

In the acquisition mode of the working machine 1, the controller 60 controls the driving of the prime mover 32 to change a rotation speed of the prime mover 32 from the prime mover rotation speed corresponding to at least the idling to the maximum prime mover rotation speed that the prime mover 32 can output. Then, the controller 60 acquires the first traveling relief pressure w1 (rpm), the second traveling relief pressure w2 (rpm), the third traveling relief pressure w3 (rpm), and the fourth traveling relief pressure w4 (rpm) every time when changing the prime mover rotation speed.

In detail, a storage (not shown in the drawings) such as a non-volatile memory provided inside the controller 60 stores in advance data of a table representing a correspondence relationship between the prime mover rotation speeds and each of the traveling relief pressures w1(rpm), w2(rpm), w3(rpm), and w4(rpm), as shown in FIG. 6. The correspondence relationship between the prime mover rotation speeds and each of the traveling relief pressures w1 (rpm), w2 (rpm), w3 (rpm), and w4 (rpm) is pre-determined according to cases and designs. When a rotation speed detector 68 (see FIG. 1) detects the prime mover rotation speed, the controller 60 reads out, from the inside storage, the first traveling relief pressure w1 (rpm), the second traveling relief pressure w2 (rpm), the third traveling relief pressure w3 (rpm), and the fourth traveling relief pressure w4 (rpm) corresponding to the prime mover rotation speeds.

In the above-described embodiment, when the first left-right differential pressure ΔZa, the second left-right differential pressure ΔZb, the third left-right differential pressure ΔZc, and the fourth left-right differential pressure ΔZd become higher than the turn threshold Z1 (rpm), it is determined to be in the turning. And, end of the turning, that is, a fact that the machine body 2 stops the turning is judged based on a turn release threshold (referred to as a second threshold) Z2 (rpm). The controller 60 determines that the turning has ended, i.e., the machine body 2 is no longer in the turning state, when any one of the first left-right differential pressure ΔZa, the second left-right differential pressure ΔZb, the third left-right differential pressure ΔZc, and the fourth left-right differential pressure ΔZd falls to or below the turn release threshold Z2 (rpm). This turn release threshold Z2 (rpm) is also determined for the rotation speeds of the prime mover 32, similarly to the turn threshold Z1 (rpm), and is determined with use of a correction factor.

Specifically, as shown in Equation (10), the controller 60 determines the turn release threshold Z2 (rpm) by multiplying respective differential pressures among the first traveling relief pressure w1 (rpm), the second traveling relief pressure w2 (rpm), the third traveling relief pressure w3 (rpm), and the fourth traveling relief pressure w4 (rpm) by a correction factor γ1.

(Equation 10)

$$Z2(rpm) = \begin{pmatrix} w3_{(rpm)} - w4_{(rpm)} \\ w1_{(rpm)} - w2_{(rpm)} \\ w4_{(rpm)} - w3_{(rpm)} \\ w2_{(rpm)} - w1_{(rpm)} \end{pmatrix} \times \gamma 1 \quad (10)$$

As shown in Equation (11), the controller 60 may acquire the turn release threshold Z2 (rpm) based on a reference value β2, the first traveling relief pressure w1 (rpm), the second traveling relief pressure w2 (rpm), the third traveling relief pressure w3 (rpm), the fourth traveling relief pressure w4 (rpm), and the correction factor γ2.

(Equation 11)

$$Z2(rpm) = \beta 2 \pm \begin{pmatrix} w3_{(rpm)} - w4_{(rpm)} \\ w1_{(rpm)} - w2_{(rpm)} \\ w4_{(rpm)} - w3_{(rpm)} \\ w2_{(rpm)} - w1_{(rpm)} \end{pmatrix} \times \gamma 2 \quad (11)$$

The controller 60 is also capable of determining whether the working machine 1 (that is, the machine body 2) travels straight or not based on the first traveling pressure LF (t, rpm), the second traveling pressure LB (t, rpm), the third traveling pressure RF (t, rpm), the fourth traveling pressure RB (t, rpm), and the turn threshold Z1(rpm).

In detail, in the traveling state of the working machine 1, the controller 60 determines that the machine body 2 is traveling straight when the first left-right differential pressure ΔZa acquired by subtracting the third traveling pressure RF (t, rpm) from the first traveling pressure LF (t, rpm), the second left-right differential pressure ΔZb acquired by subtracting the first traveling pressure LF (t, rpm) from the third traveling pressure RF (t, rpm), the third left-right differential pressure ΔZc obtained by subtracting the fourth traveling pressure RB (t, rpm) from the second traveling pressure LB (t, rpm), and the fourth left-right differential pressure ΔZd acquired by subtracting the second traveling pressure LB (t, rpm) from the fourth traveling pressure RB (t, rpm) are equal to or less than the turn threshold Z1(rpm).

When at least one of the first left-right differential pressure ΔZa, the second left-right differential pressure ΔZb, the third left-right differential pressure ΔZc, and the fourth left-right differential pressure ΔZd is higher than the turn threshold Z1 (rpm), the controller 60 determines that the machine body 2 is not traveling straight. In this case, the controller 60 determines that the machine body 2 is turning as described above.

When, after determining that the machine body 2 is turning, at least one of the first left-right differential pressure ΔZa, the second left-right differential pressure ΔZb, the third left-right differential pressure ΔZc, and the fourth left-right differential pressure ΔZd becomes equal to or less than the turn release threshold Z2 (rpm), the controller 60 determines that the machine body 2 has finished turning and the machine body 2 has started to travel straight.

The turn release threshold Z2 (rpm) may be set to a value lower than the turn threshold Z1 (rpm). In this case, the controller 60 may determine that the machine body 2 is traveling straight when the first left-right differential pressure ΔZa, the second left-right differential pressure ΔZb, the third left-right differential pressure ΔZc, and the fourth left-right differential pressure ΔZd are higher than the turn release threshold Z2 (rpm) and equal to or lower than the turn threshold Z1 (rpm). The controller 60 may also determine that the machine body 2 is turning when the first left-right differential pressure ΔZa, the second left-right differential pressure ΔZb, the third left-right differential pressure ΔZc, and the fourth left-right differential pressure ΔZd are higher than the turn release threshold Z2 (rpm) and the turn threshold Z1 (rpm).

In addition, the controller 60 may perform the automatic deceleration also when the machine body 2 is traveling straight. In this case, for example, the controller 60 performs the automatic deceleration when at least one of the first traveling pressure LF (t, rpm), the second traveling pressure LB (t, rpm), the third traveling pressure RF (t, rpm), and the fourth traveling pressure RB (t, rpm) becomes equal to or more than a predetermined straight-traveling threshold (referred to as a third threshold). The controller 60 may determine the straight-traveling threshold based on the first traveling relief pressure w1, the second traveling relief pressure w2, the third traveling relief pressure w3, and the fourth traveling relief pressure w4.

Furthermore, when a predetermined return condition is satisfied after the automatic deceleration is performed in the straight-traveling, the controller 60 may perform the automatic acceleration to accelerate rotation speeds of the traveling motors 36L and 36R from the first speed to the second speed.

According to the above embodiment, the working machine 1 has the following configurations and effects.

The working machine 1 includes the machine body 2, the prime mover 32 provided on the machine body 2, the left traveling device 5L provided on the left portion of the machine body 2, the right traveling device 5R provided on the right portion of the machine body 2, the left traveling motor 36L configured to output power to the left traveling device 5L and to be rotated at the speed stage shiftable between the first speed and the second speed higher than the first speed, the right traveling motor 36R configured to output power to the right traveling device 5R and to be rotated at the speed stage shiftable between the first speed and the second speed, the left traveling pump 53L to supply operation fluid to the left traveling motor 36L, the right traveling pump 53R to supply operation fluid to the right traveling motor 36R, the first circulation fluid line 57*h* fluidly connecting the left traveling pump 53L to the left traveling motor 36L, the first circulation fluid line 57*h* including the first passage connecting the first port 82*a* of the left traveling pump 53L to the first port P11 of the left traveling motor 36L and the second passage connecting the second port 82*b* of the left traveling pump 53L to the second port P12 of the left traveling motor 36L, the second circulation fluid line 57*i* fluidly connecting the right traveling pump 53R to the right traveling motor 36R, the second circulation fluid line 57*i* including the third passage the third port 82*c* of the right traveling pump 53R to the third port P13 of the right traveling motor 36R and the fourth passage connecting the fourth port 82*d* of the right traveling pump 53R to the fourth port P14 of the right traveling motor 36R, the first pressure detector 80*a* provided on the first passage of the first circulation fluid line 57*h* and configured to detect the first traveling pressure that is the pressure of operation fluid applied to the first passage of the first circulation fluid line 57*h* when the left traveling motor 36L rotates, the second pressure detector 80*b* provided on the second passage of the first circulation fluid line 57*h* and configured to detect the second traveling pressure that is the pressure of operation fluid applied to the second passage of the first circulation fluid line 57*h* when the left traveling motor 36L rotates, the third pressure detector 80*c* provided on the third passage of the second circulation fluid line 57*i* and configured to detect the third traveling pressure that is the pressure of operation fluid applied to the third passage of the second circulation fluid line 57*i* when the right traveling motor 36R rotates, the fourth pressure detector 80*d* provided on the fourth passage of the second circulation fluid line 57*i* and configured to detect the fourth traveling pressure that is the pressure of operation fluid applied to the fourth passage of the second circulation fluid line 57*i* when the right traveling motor 36R rotates, and the controller 60 configured to judge whether the machine body 2 is turning or not based on the first traveling pressure, the second traveling pressure, the third traveling pressure, the fourth traveling pressure, and the first threshold (that is, the turn threshold), and to change the first threshold.

According to the above, in a state in which the working machine 1 (the machine body 2) is traveling, the balance of the left traveling motor 36L and the right traveling motor 36R during forward rotation and the balance of the left traveling motor 36L and the right traveling motor 36R during reverse rotation, respectively, can be ascertained. Therefore, it can be easily ascertained whether or not the machine body 2 is in a turning state without having to detect the input of the operating member 59 by a sensor or the like. Moreover, since the controller 60 can change the first threshold value, it can properly determine whether the working machine 1 is in a turning state or not based on the first threshold value according to various situations of the working machine 1 and the respective traveling pressures described above. Then, the controller 60 can properly set the timing for performing the automatic deceleration operation in accordance with the swing state of the working machine 1, and can perform the automatic deceleration operation during the swing at said set timing.

When the working machine 1 is running (not stopped) and turning, the working machine 1 is considered as being not in the straight traveling state. Therefore, from the result of judging whether the machine body 2 is turning or not, it is possible to also judge whether or not the machine body 2 is in the straight traveling state.

In addition, the controller 60 judges whether the machine body 2 is turning or not based on the first left-right differential pressure acquired by subtracting the third traveling pressure from the first traveling pressure, the second left-right differential pressure acquired by subtracting the first traveling pressure from the third traveling pressure, the third left-right differential pressure acquired by subtracting the fourth traveling pressure from the second traveling pressure, and the fourth left-right differential pressure acquired by subtracting the second traveling pressure from the fourth traveling pressure, and the first threshold. According to this configuration, it is possible to easily grasp whether the machine body 2 is turning or not based on the balance of the left traveling motor 36L and the right traveling motor 36R during forward rotation and the balance of the left traveling motor 36L and the right traveling motor 36R during reverse rotation, respectively, while the working machine 1 is traveling.

In addition, the controller 60, after determining that the machine body s is turning, judges whether the machine body 2 finishes turning or not based on the first traveling pressure, the second traveling pressure, the third traveling pressure, the fourth traveling pressure, and the second threshold (that is, the turn release threshold). According to this configuration, after the working machine 1 (the machine body 2) has turned, it can be easily ascertained that the said turning has been properly completed.

In addition, the working machine 1 includes the machine body 2, the prime mover 32 provided on the machine body 2, the left traveling device 5L provided on the left portion of the machine body 2, the right traveling device 5R provided on the right portion of the machine body 2, the left traveling motor 36L configured to output power to the left traveling device 5L and to be rotated at the speed stage shiftable between the first speed and the second speed higher than the first speed, the right traveling motor 36R configured to output power to the right traveling device 5R and to be rotated at the speed stage shiftable between the first speed and the second speed higher than the first speed, the left traveling pump 53L to supply operation fluid to the left traveling motor 36L, the right traveling pump 53R to supply operation fluid to the right traveling motor 36R, the first circulation fluid line 57*h* fluidly connecting the left traveling pump 53L to the left traveling motor 36L and including the first passage connecting the first port 82*a* of the left traveling pump 53L to the first port P11 of the left traveling motor 36L and the second passage connecting the second port 82*b* of the left traveling pump 53L to the second port P12 of the left traveling motor 36L, the second circulation fluid line 57*i* fluidly connecting the right traveling pump 53R to the right traveling motor 36R, the second circulation fluid line 57*i* including the third passage connecting the third port 82*c* of the right traveling pump 53R to the third port P13 of the right traveling motor 36R and the fourth passage connecting the fourth port 82*d* of the right traveling pump 53R to the fourth port P14 of the right traveling motor 36R, the first pressure detector 80*a* provided on the first passage of the first circulation fluid line 57*h* and configured to detect the first traveling pressure that is the pressure of operation fluid applied to the first passage of the first circulation fluid line 57*h* when the left traveling motor 36L rotates, the second pressure detector 80*b* provided on the second passage of the first circulation fluid line 57*h* and configured to detect the second traveling pressure that is the pressure of operation fluid applied to the second passage of the first circulation fluid line 57*h* when the left traveling motor 36L rotates, the third pressure detector 80*c* provided on the third passage of the second circulation fluid line 57*i* and configured to detect the third traveling pressure that is the pressure of operation fluid applied to the third passage of the second circulation fluid line 57*i* when the right traveling motor 36R rotates, the fourth pressure detector 80*d* provided on the fourth passage of the second circulation fluid line 57*i* and configured to detect the fourth traveling pressure that is the pressure of operation fluid applied to the fourth passage of the second circulation fluid line 57*i* when the right traveling motor 36R rotates, and the controller 60 configured to judge whether the machine body 2 is traveling straight or not based on the first traveling pressure, the second traveling pressure, the third traveling pressure, the fourth traveling pressure, and the first threshold (that is, the turn threshold), and to change the first threshold.

According to the above, in the state in which the working machine 1 is traveling, the balance of the left traveling motor 36L and the right traveling motor 36R during forward rotation and the balance of the left traveling motor 36L and the right traveling motor 36R during reverse rotation, respectively, can be ascertained. Therefore, it can be easily ascertained whether or not the machine body 2 is traveling straight without having to detect the input of the operating member 59 by a sensor or the like. Moreover, since the controller 60 can change the first threshold value, it can properly determine whether the working machine 1 is turning or not based on the first threshold value according to various situations of the working machine 1 and the respective traveling pressures described above. Then, the controller 60 can properly set the timing at which the automatic deceleration is to be performed according to the straight traveling state of the working machine 1, and the automatic deceleration can be performed during straight traveling at said set timing.

When the working machine 1 in traveling is determined as traveling straight, the working machine 1 is considered as being not turning. Therefore, from the result of judging whether the machine body 2 is traveling straight or not, it is possible to also judge whether the machine body 2 is turning or not.

In addition, the controller 60 judges whether the machine body 2 is traveling straight or not based on the first left-right differential pressure acquired by subtracting the third traveling pressure from the first traveling pressure, the second left-right differential pressure acquired by subtracting the first traveling pressure from the third traveling pressure, the third left-right differential pressure acquired by subtracting the fourth traveling pressure from the second traveling pressure, and the fourth left-right differential pressure acquired by subtracting the second traveling pressure from the fourth traveling pressure, and the first threshold (that is, the turn threshold). According to this configuration, it is possible to easily grasp whether or not the machine body 2 is traveling straight based on the balance when the left traveling motor 36L and the right traveling motor 36R are in forward rotation and the balance when the left traveling motor 36L and the right traveling motor 36R are in reverse rotation, respectively, while the working machine 1 is traveling.

In addition, after determining that the machine body 2 is turning based on the first traveling pressure, the second traveling pressure, the third traveling pressure, the fourth traveling pressure, and the first threshold, the controller 60 judges whether the machine body 2 starts to travel straight based on the first traveling pressure, the second traveling pressure, the third traveling pressure, the fourth traveling pressure, and the second threshold (that is, the turn release threshold). According to this method, it can be easily ascertained that the working machine 1 has finished turning and has started going straight.

In addition, the controller 60 changes the first threshold (that is, the turn threshold) based on the first traveling pressure, the second traveling pressure, the third traveling pressure, or the fourth traveling pressure. According to this configuration, the first threshold can be set according to various changes in the situation of the working machine 1, and the turning state or the straight traveling state of the working machine 1 can be judged more appropriately.

In addition, the working machine 1 includes the first relief valve 81*a* connected to the first passage of the first circulation fluid line 57*h* connected to the first port 82*a*, the second relief valve 81*b* connected to the second passage of the first circulation fluid line 57*h* connected to the second port 82*b*, the third relief valve 81*c* connected to the third passage of the second circulation fluid line 57*i* connected to the third port 82*c*, and the fourth relief valve 81*d* connected to the fourth passage of the second circulation fluid line 57*i* connected to the fourth port 82*d*. The controller 60 determines the first threshold based on the first traveling relief pressure of the first relief valve 81*a*, the second traveling relief pressure of the second relief valve 81*b*, the third traveling relief pressure of the third relief valve 81*c*, and the fourth traveling relief pressure of the fourth relief valve 81*d*, which are defined according a rotation speed of the prime mover 32.

According to this configuration, the first threshold value can be properly set according to the first traveling relief pressure, the second traveling relief pressure, the third traveling relief pressure, and the fourth traveling relief pressure in the working machine 1, that is, according to the state of the relief valve installed in the working machine 1.

In addition, the controller 60 determines the second threshold (that is, the turn release threshold) based on the first traveling relief pressure, the second traveling relief pressure, the third traveling relief pressure, and the fourth traveling relief pressure. According to this configuration, the second threshold value can be properly set based on the respective traveling relief pressures of the respective relief valves 81*a* to 81*d*, which are activated according to various situations of the working machine 1.

Further, in a state where the left traveling motor 36L and the right traveling motor 36R are each rotated at the second speed defining a high speed range, the controller 60 performs the automatic deceleration operation to automatically decelerate the left traveling motor 36L and the right traveling motor 36R by shifting the speed stage of rotation of each of the left and right traveling motors 36L and 36R from the second speed to the first speed defining a low speed range. According to this configuration, it is possible to judge whether or not the turning state of the working machine 1 is correct, whether or not the straight traveling state is correct, and whether or not the automatic deceleration operation is appropriate, based on the same parameters such as the first traveling pressure, the second traveling pressure, the third traveling pressure, or the fourth traveling pressure. As a result, automatic deceleration operation can be properly executed when the working machine 1 is turning or going straight, and it is possible to improve the safety when the machine body 2 is traveling and the convenience by automation.

In the above-described embodiment, the first threshold (that is, the turn threshold) is determined and changed based on the respective traveling relief pressures (that is, the first traveling relief pressure to fourth traveling relief pressure) of the relief valves 81*a* to 81*d*. However, the first threshold may be changed based on a temperature of operation fluid (that is, a fluid temperature) or a rotation speed of the prime mover 32 (that is, the prime mover rotation speed). For example, the controller 60 determines and changes the first threshold value based on the prime mover rotation speed detected by the rotation speed detector 68. Alternatively, the controller 60 detects a temperature (that is, the fluid temperature) of operation fluid flowing to the traveling motors 36L and 36R or the traveling pumps 53L and 53R by a fluid temperature detector, and determines and changes the first threshold value based on the detected fluid temperature.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:

a machine body;

a prime mover provided on the machine body;

a left traveling device provided on a left portion of the machine body;

a right traveling device provided on a right portion of the machine body;

a left traveling motor configured to output power to the left traveling device and to be rotated at a speed stage shiftable between a first speed and a second speed higher than the first speed;

a right traveling motor configured to output power to the right traveling device and to be rotated at a speed stage shiftable between the first speed and the second speed higher than the first speed;

a left traveling pump to supply operation fluid to the left traveling motor, the left traveling pump having a first port to output the operation fluid for forward rotation of the left traveling motor and a second port to output the operation fluid for reverse rotation of the left traveling motor;

a right traveling pump to supply the operation fluid to the right traveling motor, the right traveling pump having a third port to output the operation fluid for forward rotation of the right traveling motor and a fourth port to output the operation fluid for reverse rotation of the right traveling motor;

a first circulation fluid line fluidly connecting the left traveling pump to the left traveling motor, the first circulation fluid line including a first passage connecting the first port of the left traveling pump to a first port of the left traveling motor, and a second passage connecting the second port of the left traveling pump to a second port of the left traveling motor;

a second circulation fluid line fluidly connecting the right traveling pump to the right traveling motor, the second circulation fluid line including a third passage connecting the third port of the right traveling pump to a third port of the right traveling motor, and a fourth passage connecting the fourth port of the right traveling pump to a fourth port of the right traveling motor;

a first pressure detector provided on the first passage and configured to detect a first traveling pressure that is a pressure of the operation fluid applied to the first passage when the left traveling motor rotates;

a second pressure detector provided on the second passage and configured to detect a second traveling pressure that is a pressure of the operation fluid applied to the second passage when the left traveling motor rotates;

a third pressure detector provided on the third passage and configured to detect a third traveling pressure that is a pressure of the operation fluid applied to the third passage when the right traveling motor rotates;

a fourth pressure detector provided on the fourth passage and configured to detect a fourth traveling pressure that is a pressure of the operation fluid applied to the fourth passage when the right traveling motor rotates;

a controller configured to judge a traveling state of the machine body including whether the machine body is turning or not based on the first traveling pressure, the second traveling pressure, the third traveling pressure, the fourth traveling pressure, and a first threshold, and to change the first threshold;

a first relief valve connected to the first passage;

a second relief valve connected to the second passage;

a third relief valve connected to the third passage; and a fourth relief valve connected to the fourth passage, wherein the controller acquires a first traveling relief pressure of the first relief valve, a second traveling relief pressure of the second relief valve, a third traveling relief pressure of the third relief valve, and a fourth traveling relief pressure of the fourth relief valve, the first, second, third and fourth traveling relief pressures being determined in correspondence to a rotation speed of the prime mover, and the controller determines the first threshold based on a first differential pressure, a second differential pressure, a third differential pressure, and a fourth differential pressure, the first differential pressure being calculated by subtracting the third traveling relief pressure from the first traveling relief pressure, the second differential pressure being calculated by subtracting the first traveling relief pressure from the third traveling relief pressure, the third differential pressure being calculated by subtracting the fourth traveling relief pressure from the second traveling relief pressure, and the fourth differential pressure being calculated by subtracting the second traveling relief pressure from the fourth traveling relief pressure.

2. The working machine according to claim 1, wherein the first pressure detector detects the first traveling pressure that is the pressure of the operation fluid applied to the first passage also when the left traveling motor is not rotating;

the second pressure detector detects the second traveling pressure that is the pressure of the operation fluid applied to the second passage also when the left traveling motor is not rotating;

the third pressure detector detects the third traveling pressure that is the pressure of the operation fluid applied to the third passage also when the right traveling motor is not rotating;

the fourth pressure detector detects the fourth traveling pressure that is the pressure of the operation fluid applied to the fourth passage also when the right traveling motor is not rotating;

the controller judges the traveling state of the machine body based on a first left-right differential pressure acquired by subtracting the third traveling pressure from the first traveling pressure, a second left-right differential pressure acquired by subtracting the first traveling pressure from the third traveling pressure, a third left-right differential pressure acquired by subtracting the fourth traveling pressure from the second traveling pressure, and a fourth left-right differential pressure acquired by subtracting the second traveling pressure from the fourth traveling pressure, and the first threshold; and the controller determines that the machine body is turning if at least one of the first left-right differential pressure, the second left-right differential pressure, the third left-right differential pressure, or the fourth left-right differential pressure is higher than the first threshold, and determines that the machine body is not turning if the first left-right differential pressure, the second left-right differential pressure, the third left-right differential pressure, and the fourth left-right differential pressure are each equal to or less than the first threshold.

3. The working machine according to claim 2, wherein the controller, after determining that the machine body is turning, judges whether the machine body has finished turning or not based on the first left-right differential pressure, the second left-right differential pressure, the third left-right differential pressure, the fourth left-right differential pressure, and a second threshold.

4. The working machine according to claim 1, wherein the controller, after determining that the machine body is turning, judges whether the machine body has finished turning or not based on the first traveling pressure, the second traveling pressure, the third traveling pressure, the fourth traveling pressure, and a second threshold.

5. The working machine according to claim 4, wherein the controller determines the second threshold based on the first differential pressure, the second differential pressure, the third differential pressure, and the fourth differential pressure.

6. The working machine according to claim 1, wherein in a state where the left traveling motor and the right traveling motor are each rotated at the second speed defining a high speed range, the controller performs an automatic deceleration operation to automatically decelerate the left traveling motor and the right traveling motor by shifting the speed stage of rotation of each of the left and right traveling motors from the second speed to the first speed defining a low speed range based on the first traveling pressure, the second traveling pressure, the third traveling pressure, and the fourth traveling pressure.

7. A working machine comprising:

a machine body;

a prime mover provided on the machine body;

a left traveling device provided on a left portion of the machine body;

a right traveling device provided on a right portion of the machine body;

a left traveling motor configured to output power to the left traveling device and to be rotated at a speed stage shiftable between a first speed and a second speed higher than the first speed;

a right traveling motor configured to output power to the right traveling device and to be rotated at a speed stage shiftable between the first speed and the second speed higher than the first speed;

a left traveling pump to supply operation fluid to the left traveling motor, the left traveling pump having a first port to output the operation fluid for forward rotation of the left traveling motor and a second port to output the operation fluid for reverse rotation of the left traveling motor;

a right traveling pump to supply the operation fluid to the right traveling motor, the right traveling pump having a third port to output the operation fluid for forward rotation of the right traveling motor and a fourth port to output the operation fluid for reverse rotation of the right traveling motor;

a first circulation fluid line fluidly connecting the left traveling pump to the left traveling motor, the first circulation fluid line including a first passage connecting the first port of the left traveling pump to a first port of the left traveling motor, and a second passage connecting the second port of the left traveling pump to a second port of the left traveling motor;

a second circulation fluid line fluidly connecting the right traveling pump to the right traveling motor, the second circulation fluid line including a third passage connecting the third port of the right traveling pump to a third port of the right traveling motor, and a fourth passage connecting the fourth port of the right traveling pump to a fourth port of the right traveling motor;

a first pressure detector provided on the first passage and configured to detect a first traveling pressure that is a pressure of the operation fluid applied to the first passage when the left traveling motor rotates;

a second pressure detector provided on the second passage and configured to detect a second traveling pressure that is a pressure of the operation fluid applied to the second passage when the left traveling motor rotates;

a third pressure detector provided on the third passage and configured to detect a third traveling pressure that is a pressure of the operation fluid applied to the third passage when the right traveling motor rotates;

a fourth pressure detector provided on the fourth passage and configured to detect a fourth traveling pressure that is a pressure of the operation fluid applied to the fourth passage when the right traveling motor rotates;

a controller configured to judge a traveling state of the machine body including whether the machine body is traveling straight or not based on the first traveling pressure, the second traveling pressure, the third traveling pressure, the fourth traveling pressure, and a first threshold, and to change the first threshold;

a first relief valve connected to the first passage;

a second relief valve connected to the second passage;

a third relief valve connected to the third passage; and a fourth relief valve connected to the fourth passage, wherein the controller acquires a first traveling relief pressure of the first relief valve, a second traveling relief pressure of the second relief valve, a third traveling relief pressure of the third relief valve, and a fourth traveling relief pressure of the fourth relief valve, the first, second, third and fourth traveling relief pressures being determined in correspondence to a rotation speed of the prime mover, and the controller determines the first threshold based on a first differential pressure, a second differential pressure, a third differential pressure, and a fourth differential pressure, the first differential pressure being calculated by subtracting the third traveling relief pressure from the first traveling relief pressure, the second differential pressure being calculated by subtracting the first traveling relief pressure from the third traveling relief pressure, the third differential pressure being calculated by subtracting the fourth traveling relief pressure from the second traveling relief pressure, and the fourth differential pressure being calculated by subtracting the second traveling relief pressure from the fourth traveling relief pressure.

8. The working machine according to claim 7, wherein the first pressure detector detects the first traveling pressure that is the pressure of the operation fluid applied to the first passage also when the left traveling motor is not rotating;

the second pressure detector detects the second traveling pressure that is the pressure of the operation fluid applied to the second passage also when the left traveling motor is not rotating;

the third pressure detector detects the third traveling pressure that is the pressure of the operation fluid applied to the third passage also when the right traveling motor is not rotating;

the fourth pressure detector detects the fourth traveling pressure that is the pressure of the operation fluid applied to the fourth passage also when the right traveling motor is not rotating;

the controller judges the traveling state of the machine body based on a first left-right differential pressure acquired by subtracting the third traveling pressure from the first traveling pressure, a second left-right differential pressure acquired by subtracting the first traveling pressure from the third traveling pressure, a third left-right differential pressure acquired by subtracting the fourth traveling pressure from the second traveling pressure, and a fourth left-right differential pressure acquired by subtracting the second traveling pressure from the fourth traveling pressure, and the first threshold; and the controller determines that the machine body is traveling straight if the first left-right differential pressure, the second left-right differential pressure, the third left-right differential pressure, and the fourth left-right differential pressure are each equal to or less than the first threshold, and determines that the machine body is not traveling straight if at least one of the first left-right differential pressure, the second left-right differential pressure, the third left-right differential pressure, or the fourth left-right differential pressure is higher than the first threshold.

9. The working machine according to claim 8, wherein after determining that the machine body is not traveling straight but is turning based on the first left-right differential pressure, the second left-right differential pressure, the third left-right differential pressure, the fourth left-right differential pressure, and the first threshold, the controller judges whether the machine body has started to travel straight or not based on the first left-right differential pressure, the second left-right differential pressure, the third left-right differential pressure, the fourth left-right differential pressure, and a second threshold.

10. The working machine according to claim 7, wherein after determining that the machine body is not traveling straight but is turning based on the first traveling pressure, the second traveling pressure, the third traveling pressure, the fourth traveling pressure, and the first threshold, the controller judges whether the machine body has started to travel straight or not based on the first traveling pressure, the second traveling pressure, the third traveling pressure, the fourth traveling pressure, and a second threshold.

11. The working machine according to claim 10, wherein the controller determines the second threshold based on the first differential pressure, the second differential pressure, the third differential pressure, and the fourth differential pressure.

12. A working machine comprising:

a machine body;

a prime mover provided on the machine body;

a left traveling device provided on a left portion of the machine body;

a right traveling device provided on a right portion of the machine body;

a left traveling motor configured to output power to the left traveling device and to be rotated at a speed stage shiftable between a first speed and a second speed higher than the first speed;

a right traveling motor configured to output power to the right traveling device and to be rotated at a speed stage shiftable between the first speed and the second speed higher than the first speed;

a left traveling pump to supply operation fluid to the left traveling motor, the left traveling pump having a first port to output the operation fluid for forward rotation of the left traveling motor and a second port to output the operation fluid for reverse rotation of the left traveling motor;

a right traveling pump to supply the operation fluid to the right traveling motor, the right traveling pump having a third port to output the operation fluid for forward rotation of the right traveling motor and a fourth port to output the operation fluid for reverse rotation of the right traveling motor;

a first circulation fluid line fluidly connecting the left traveling pump to the left traveling motor, the first circulation fluid line including a first passage connecting the first port of the left traveling pump to a first port of the left traveling motor, and a second passage connecting the second port of the left traveling pump to a second port of the left traveling motor;

a second circulation fluid line fluidly connecting the right traveling pump to the right traveling motor, the second circulation fluid line including a third passage connecting the third port of the right traveling pump to a third port of the right traveling motor, and a fourth passage connecting the fourth port of the right traveling pump to a fourth port of the right traveling motor;

a first pressure detector provided on the first passage and configured to detect a first traveling pressure that is a pressure of the operation fluid applied to the first passage when the left traveling motor rotates;

a second pressure detector provided on the second passage and configured to detect a second traveling pressure that is a pressure of the operation fluid applied to the second passage when the left traveling motor rotates;

a third pressure detector provided on the third passage and configured to detect a third traveling pressure that is a pressure of the operation fluid applied to the third passage when the right traveling motor rotates;

a fourth pressure detector provided on the fourth passage and configured to detect a fourth traveling pressure that is a pressure of the operation fluid applied to the fourth passage when the right traveling motor rotates;

a controller configured to judge a traveling state of the machine body including whether the machine body is turning or not based on the first traveling pressure, the second traveling pressure, the third traveling pressure, the fourth traveling pressure, and a first threshold, and to change the first threshold;

a first relief valve connected to the first passage;

a second relief valve connected to the second passage;

a third relief valve connected to the third passage; and a fourth relief valve connected to the fourth passage, wherein the controller, after determining that the machine body is turning, judges whether the machine body has finished turning or not based on the first traveling pressure, the second traveling pressure, the third traveling pressure, the fourth traveling pressure, and a second threshold, the controller acquires a first traveling relief pressure of the first relief valve, a second traveling relief pressure of the second relief valve, a third traveling relief pressure of the third relief valve, and a fourth traveling relief pressure of the fourth relief valve, the first, second, third and fourth traveling relief pressures being determined in correspondence to a rotation speed of the prime mover, and the controller determines the second threshold based on a first differential pressure, a second differential pressure, a third differential pressure, and a fourth differential pressure, the first differential pressure being calculated by subtracting the third traveling relief pressure from the first traveling relief pressure, the second differential pressure being calculated by subtracting the first traveling relief pressure from the third traveling relief pressure, the third differential pressure being calculated by subtracting the fourth traveling relief pressure from the second traveling relief pressure, and the fourth differential pressure being calculated by subtracting the second traveling relief pressure from the fourth traveling relief pressure.

13. A working machine, comprising:

a machine body;

a prime mover provided on the machine body;

a left traveling device provided on a left portion of the machine body;

a right traveling device provided on a right portion of the machine body;

a left traveling motor configured to output power to the left traveling device and to be rotated at a speed stage shiftable between a first speed and a second speed higher than the first speed;

a right traveling motor configured to output power to the right traveling device and to be rotated at a speed stage shiftable between the first speed and the second speed higher than the first speed;

a left traveling pump to supply operation fluid to the left traveling motor, the left traveling pump having a first port to output the operation fluid for forward rotation of the left traveling motor and a second port to output the operation fluid for reverse rotation of the left traveling motor;

a right traveling pump to supply the operation fluid to the right traveling motor, the right traveling pump having a third port to output the operation fluid for forward rotation of the right traveling motor and a fourth port to output the operation fluid for reverse rotation of the right traveling motor;

a first circulation fluid line fluidly connecting the left traveling pump to the left traveling motor, the first circulation fluid line including a first passage connecting the first port of the left traveling pump to a first port of the left traveling motor, and a second passage connecting the second port of the left traveling pump to a second port of the left traveling motor;

a second circulation fluid line fluidly connecting the right traveling pump to the right traveling motor, the second circulation fluid line including a third passage connecting the third port of the right traveling pump to a third port of the right traveling motor, and a fourth passage connecting the fourth port of the right traveling pump to a fourth port of the right traveling motor;

a first pressure detector provided on the first passage and configured to detect a first traveling pressure that is a pressure of the operation fluid applied to the first passage when the left traveling motor rotates;

a second pressure detector provided on the second passage and configured to detect a second traveling pressure that is a pressure of the operation fluid applied to the second passage when the left traveling motor rotates;

a third pressure detector provided on the third passage and configured to detect a third traveling pressure that is a pressure of the operation fluid applied to the third passage when the right traveling motor rotates;

a fourth pressure detector provided on the fourth passage and configured to detect a fourth traveling pressure that is a pressure of the operation fluid applied to the fourth passage when the right traveling motor rotates;

a controller configured to judge a traveling state of the machine body including whether the machine body is traveling straight or not based on the first traveling pressure, the second traveling pressure, the third traveling pressure, the fourth traveling pressure, and a first threshold, and to change the first threshold;

a first relief valve connected to the first passage;

a second relief valve connected to the second passage;

a third relief valve connected to the third passage; and a fourth relief valve connected to the fourth passage, wherein after determining that the machine body is not traveling straight but is turning based on the first traveling pressure, the second traveling pressure, the third traveling pressure, the fourth traveling pressure, and the first threshold, the controller judges whether the machine body has started to travel straight or not based on the first traveling pressure, the second traveling pressure, the third traveling pressure, the fourth traveling pressure, and a second threshold, the controller acquires a first traveling relief pressure of the first relief valve, a second traveling relief pressure of the second relief valve, a third traveling relief pressure of the third relief valve, and a fourth traveling relief pressure of the fourth relief valve, the first, second, third and fourth traveling relief pressures being determined in correspondence to a rotation speed of the prime mover, and the controller determines the second threshold based on a first differential pressure, a second differential pressure, a third differential pressure, and a fourth differential pressure, the first differential pressure being calculated by subtracting the third traveling relief pressure from the first traveling relief pressure, the second differential pressure being calculated by subtracting the first traveling relief pressure from the third traveling relief pressure, the third differential pressure being calculated by subtracting the fourth traveling relief pressure from the second traveling relief pressure, and the fourth differential pressure being calculated by subtracting the second traveling relief pressure from the fourth traveling relief pressure.

* * * * *